US010910717B2

(12) United States Patent
Inoue et al.

(10) Patent No.: US 10,910,717 B2
(45) Date of Patent: Feb. 2, 2021

(54) ANTENNA DEVICE

(71) Applicant: SUMIDA CORPORATION, Tokyo (JP)

(72) Inventors: Yoshinori Inoue, Natori (JP); Isao Douchi, Natori (JP); Kei Tanaka, Natori (JP); Takanari Fujimaki, Natori (JP); Yoshinori Miura, Natori (JP); Hiroshi Kawasaki, Natori (JP); Hiromitsu Kuriki, Natori (JP); Takanobu Rokuka, Natori (JP); Hiroyuki Miyazaki, Natori (JP)

(73) Assignee: SUMIDA CORPORATION, Tokyo (JP)

( * ) Notice: Subject to any disclaimer, the term of this patent is extended or adjusted under 35 U.S.C. 154(b) by 469 days.

(21) Appl. No.: 15/835,973

(22) Filed: Dec. 8, 2017

(65) Prior Publication Data

US 2018/0166783 A1 Jun. 14, 2018

(30) Foreign Application Priority Data

Dec. 9, 2016 (JP) ..... 2016-239799

(51) Int. Cl.

| | |
|---|---|
| ***H01Q 7/08*** | (2006.01) |
| ***H01F 27/26*** | (2006.01) |
| ***H01Q 1/32*** | (2006.01) |
| ***H01F 38/14*** | (2006.01) |
| ***H01F 27/02*** | (2006.01) |

(52) U.S. Cl.

CPC ..... *H01Q 7/08* (2013.01); *H01F 27/02* (2013.01); *H01F 27/266* (2013.01); *H01F 38/14* (2013.01); *H01Q 1/3241* (2013.01)

(58) Field of Classification Search

CPC ..... H01Q 7/00–7/08; H01Q 1/2208; H01Q 1/32; H01Q 1/22

See application file for complete search history.

(56) References Cited

U.S. PATENT DOCUMENTS

| | | | | |
|---|---|---|---|---|
| 8,044,875 | B2 * | 10/2011 | Nishino | H01F 3/00 343/788 |
| 10,038,242 | B2 * | 7/2018 | Imai | H01Q 7/08 |
| 2009/0278689 | A1 | 11/2009 | Gisselberg et al. | |
| 2016/0315388 | A1 * | 10/2016 | Imai | H01Q 1/3241 |
| 2017/0095210 | A1 * | 4/2017 | Najafi | A61B 5/6869 |

FOREIGN PATENT DOCUMENTS

| | | | |
|---|---|---|---|
| EP | 2866301 | A1 | 4/2015 |
| JP | 2007043588 | A | 2/2007 |
| JP | 2012044592 | A | 3/2012 |
| WO | 2005057727 | A1 | 6/2005 |

OTHER PUBLICATIONS

European Search Report corresponding to Application No. 17205825; dated Mar. 29, 2018.

The First Chinese Office Action; corresponding to Application No. 201711045544.X; dated May 3, 2020.

* cited by examiner

*Primary Examiner* — Hasan Z Islam

(74) *Attorney, Agent, or Firm* — Cantor Colburn LLP

(57) ABSTRACT

An antenna device including a first rod-shaped core having a flange portion and a second rod-shaped core having a flange portion, which are arranged in series and including a first coil and a second coil, wherein the end surface of the first rod-shaped core and the end surface of the second rod-shaped core are spaced.

4 Claims, 13 Drawing Sheets

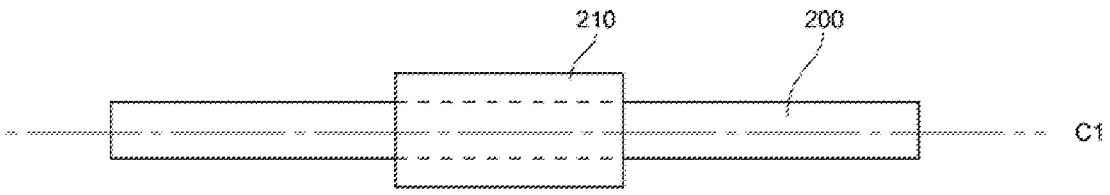
FIG. 12A
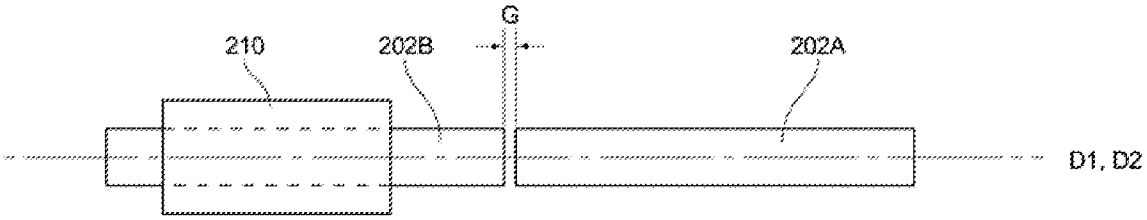
FIG. 12B
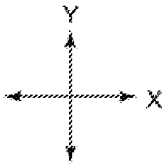

ANTENNA DEVICE

CROSS REFERENCES TO RELATED APPLICATIONS

The present invention is based upon and claims the benefit of priority from Japanese Patent Application JP2016-239799 filed on Dec. 9, 2016, the entire contents of which being incorporated herein by reference.

BACKGROUND OF THE INVENTION

Field of the Invention

The present invention related to an antenna device.

Description of the Related Art

In an antenna device, there is used a rod-shaped core composed of such a magnetic body material as a Mn—Zn ferrite or the like. While in order to heighten the output of this antenna device, it is advantageous for the length of the rod-shaped core to be the larger, there is such a defect that the rod-shaped core will be damaged and becomes easy to break when an impact or a bending stress is added to the rod-shaped core. In order to solve such a problem, there has been proposed an antenna device in which the length of each rod-shaped core is shortened by using a plurality of rod-shaped cores arranged in series along one direction (for example, see Patent Document 1: Japanese unexamined patent publication No. 2007-43588 or the like).

SUMMARY OF THE INVENTION

However, in an antenna device including a plurality of rod-shaped cores arranged in series, when the length (gap length) between the mutually neighboring two rod-shaped cores fluctuates or when there occurs a positional-deviation (axial misalignment) between the mutual center axes of the mutually neighboring two rod-shaped cores, it happens that the inductance value thereof will change.

The present invention was invented in view of the above-mentioned situation and addressed to provide an antenna device which can suppress the fluctuation of the inductance value.

The antenna device of the present invention is characterized by including: a plurality of rod-shaped cores arranged in series; a first coil formed by winding a conductive wire around the outer circumferential side of a first rod-shaped core which is selected from the plurality of rod-shaped cores; a second coil formed by winding a conductive wire around the outer circumferential side of a second rod-shaped core which is selected from the plurality of rod-shaped cores and also, which is arranged close to either one side of the end-portions of the first rod-shaped core, wherein an end surface of the first rod-shaped core, close to which the second rod-shaped core is arranged, is spaced from an end surface of the second rod-shaped core, close to which the first rod-shaped core is arranged, there is provided a flange portion at the end portion on the side of the first rod-shaped core, close to which the second rod-shaped core is arranged, and also, there is provided a flange portion at the end portion on the side of the second rod-shaped core, close to which the first rod-shaped core is arranged.

It is preferable for another exemplified embodiment of the antenna device of the present invention to further include: a tubular housing member which houses at least the first rod-shaped core and the second rod-shaped core, wherein the inside of the space between the end surface of the first rod-shaped core, close to which the second rod-shaped core is arranged and the end surface of the second rod-shaped core, close to which the first rod-shaped core is arranged, is occupied by any one selected from the following materials of (i) to (iv): (i) a material composed of only gas, (ii) a material containing gas and liquid substance, (iii) a material containing gas and fine solid substance, and (iv) a material containing gas and sponge-like substance.

It is preferable for another exemplified embodiment of the antenna device of the present invention to further include: a tubular housing member which houses at least the first rod-shaped core and the second rod-shaped core, wherein when taking the direction orthogonal to the arrangement-direction of the plurality of rod-shaped cores as a first direction and taking the direction orthogonal to the arrangement-direction of the plurality of rod-shaped cores and also orthogonal to the first direction as a second direction, the entire surface of at least one area selected from the following areas of (i) to (iv) is spaced from the inner circumferential surface of the tubular housing member: (i) an area, within the outer circumferential surfaces of the flange portion of the first rod-shaped core, which is orthogonal to the first direction; (ii) an area, within the outer circumferential surfaces of the flange portion of the first rod-shaped core, which is orthogonal to the second direction; (iii) an area, within the outer circumferential surfaces of the flange portion of the second rod-shaped core, which is orthogonal to the first direction; and (iv) an area, within the outer circumferential surfaces of the flange portion of the second rod-shaped core, which is orthogonal to the second direction.

It is preferable for another exemplified embodiment of the antenna device of the present invention to further include: a tubular housing member which houses at least the first rod-shaped core and the second rod-shaped core, wherein when taking the direction orthogonal to the arrangement-direction of the plurality of rod-shaped cores as a first direction and taking the direction orthogonal to the arrangement-direction of the plurality of rod-shaped cores and also orthogonal to the first direction as a second direction, the following portions of (i) to (iv) are in close contact with the inner circumferential surface of the tubular housing member: (i) at least a portion of an area, within the outer circumferential surfaces of the flange portion of the first rod-shaped core, which is orthogonal to the first direction; (ii) at least a portion of an area, within the outer circumferential surfaces of the flange portion of the first rod-shaped core, which is orthogonal to the second direction; (iii) at least a portion of an area, within the outer circumferential surfaces of the flange portion of the second rod-shaped core, which is orthogonal to the first direction; and (iv) at least a portion of an area, within the outer circumferential surfaces of the flange portion of the second rod-shaped core, which is orthogonal to the second direction.

It is preferable for another exemplified embodiment of the antenna device of the present invention to further include: a tubular housing member which houses at least the first rod-shaped core and the second rod-shaped core, wherein the inner circumferential side of the tubular housing member is provided with the followings (A) to (C): (A) either one of the members selected from the following (A1) and (A2): (A1) a partition plate which is in close contact with the end surface of the first rod-shaped core, close to which the second rod-shaped core is arranged and in close contact with the end surface of the second rod-shaped core, close to which the first rod-shaped core is arranged, and (A2) a protrusion which is in close contact with the end surface of the first rod-shaped core, close to which the second rod-shaped core is arranged and in close contact with the end surface of the second rod-shaped core, close to which the first rod-shaped core is arranged; (B) a protrusion which is in close contact with the end surface positioned on the opposite side from the side of the flange portion of the first rod-shaped core, close to which the second rod-shaped core is provided; and (C) a protrusion which is in close contact with the end surface positioned on the opposite side from the side of the flange portion of the second rod-shaped core, close to which the first rod-shaped core is provided.

It is preferable for another exemplified embodiment of the antenna device of the present invention to have a constitution in which the end surface of the first rod-shaped core, close to which the second rod-shaped core is arranged, and the end surface of the second rod-shaped core, close to which the first rod-shaped core is arranged, are bonded through an adhesive-agent layer.

It is preferable for another exemplified embodiment of the antenna device of the present invention to further include: a tubular housing member which houses at least the first rod-shaped core and the second rod-shaped core, wherein the inner circumferential side of the tubular housing member is provided with a first groove and a second groove so as to be neighboring to each other with respect to the longitudinal direction of the tubular housing member; wherein toward the direction in parallel with the arrangement-direction of the plurality of rod-shaped cores, the width of the first groove is identical with the width of the flange portion of the first rod-shaped core and, the width of the second groove is identical with the width of the flange portion of the second rod-shaped core; and wherein the circumferential portion of the flange portion of the first rod-shaped core is fitted inside the first groove and also, the circumferential portion of the flange portion of the second rod-shaped core is fitted inside the second groove.

According to the present invention, it is possible to provide an antenna device in which the fluctuation of the inductance value can be suppressed.

BRIEF DESCRIPTION OF THE DRAWINGS

FIGS. 12A and 12B are schematic views showing arrangement-relationships between the rod-shaped cores and the coils in Experimental-Example 1 and Experimental-Example 2 shown in Table-3, wherein FIG. 12A is a drawing showing the arrangement-relationship between the rod-shaped core and the coil in the Experimental-Example 1 and FIG. 12B is a drawing showing the arrangement-relationship between the rod-shaped core and the coil in the Experimental-Example 2.

DESCRIPTION OF THE PREFERRED EMBODIMENTS

Figure 1:
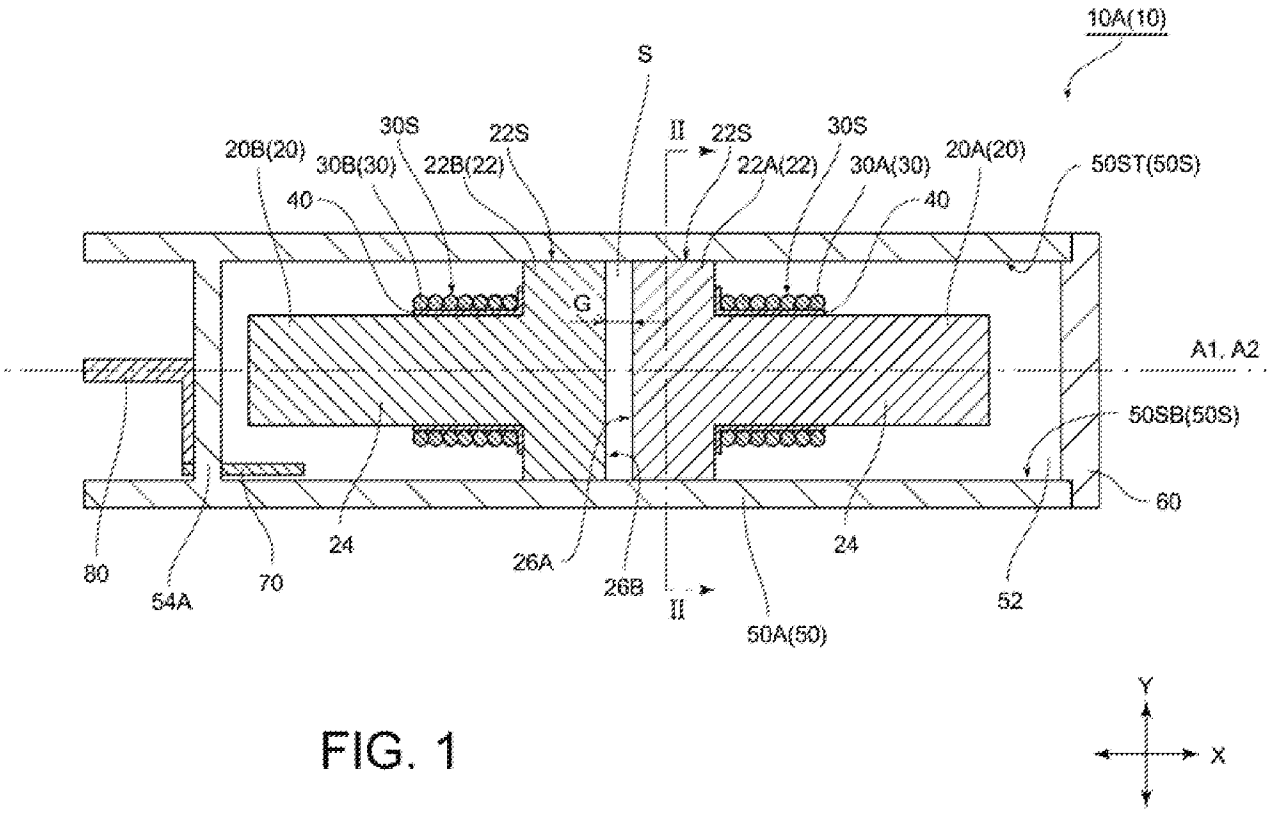
FIG. 1 is a schematic cross-sectional view (XY cross-sectional view) showing one example of an antenna device of the present exemplified embodiment.
Figure 2:
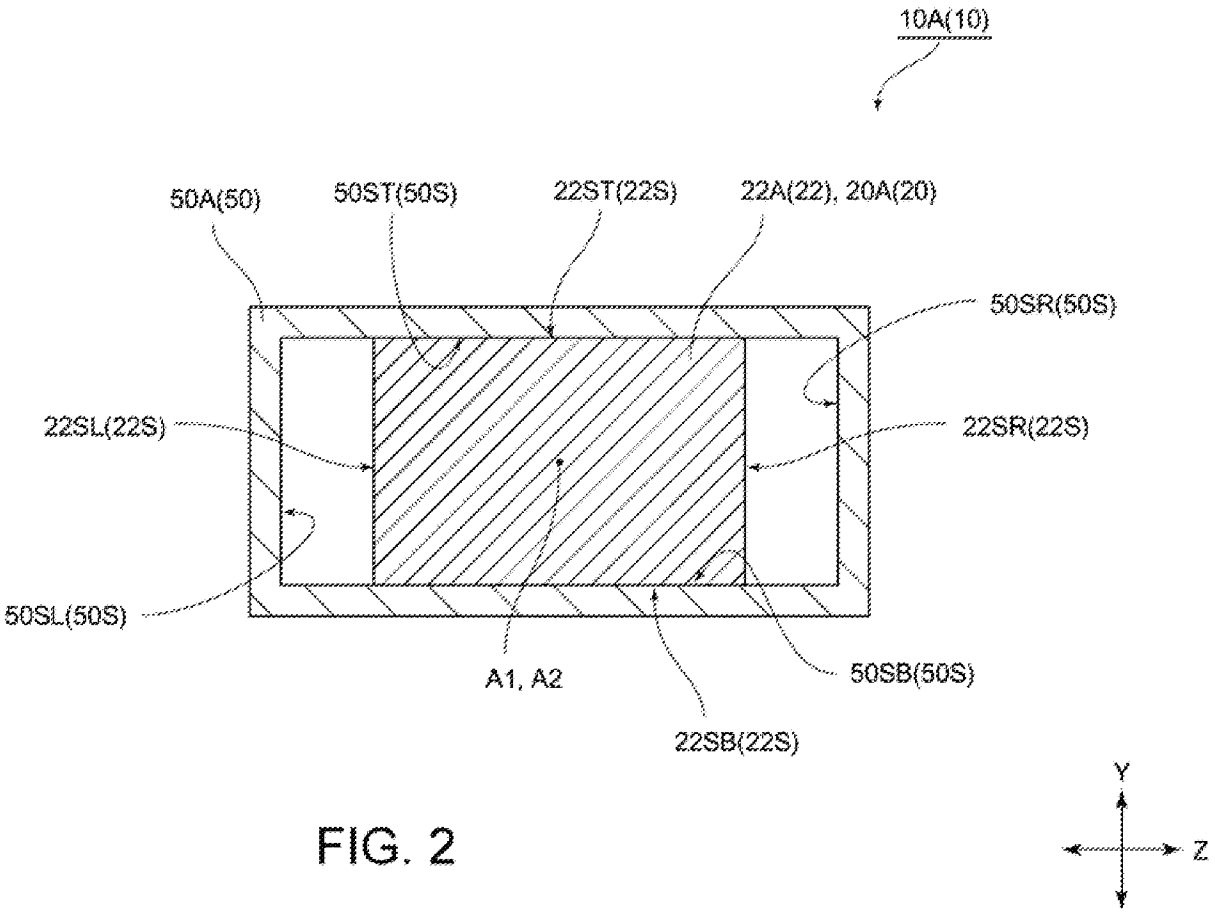
FIG. 2 is a schematic cross-sectional view (YZ cross-sectional view) showing one example of a cross-sectional structure of the antenna device shown in FIG. 1.

FIG. 1 is a schematic cross-sectional view showing one example of an antenna device of the present exemplified embodiment, and FIG. 2 is a schematic cross-sectional view showing one example of a cross-sectional structure of the antenna device shown in FIG. 1. It should be noted that FIG. 2 shows a cross-sectional structure at the line between the numerals II-II in FIG. 1. Here, in FIGS. 1 and 2, and in the succeeding figures including FIG. 3 which will be described below, the X-axis direction, the Y-axis direction (referred to as "first direction" in some cases hereinafter) and the Z-axis direction (referred to as "second direction" in some cases hereinafter), which are shown in the drawings, are directions which are orthogonal to one another. In addition, the X-axis direction is in parallel with the arrangement-direction of two rod-shaped cores 20 shown in FIG. 1 and, is also in parallel with a center axis A1 of a first rod-shaped core 20A (20) and a center axis A2 of a second rod-shaped core 20B (20). This configuration is substantially similar also with regard to the rod-shaped cores shown in the succeeding figures including FIG. 3.

An antenna device 10A (10) of the present exemplified embodiment shown in FIG. 1 includes, for its main portion, plural bodies of rod-shaped cores 20 (two bodies in the example shown in FIG. 1) which are arranged in series and includes a first coil 30A (30) and a second coil 30B (30). On the outer circumferential side of one rod-shaped core (first rod-shaped core 20A) which is selected from these two rod-shaped cores 20, there is provided a first coil 30A formed by winding a conductive wire, and on the outer circumferential side of the other rod-shaped core (second rod-shaped core 20B) which is selected from the two rod-shaped cores 20 and also is arranged on one end-portion side of the first rod-shaped core 20A, there is provided a second coil 30B formed by winding a conductive wire. In addition, the first coil 30A and the second coil 30B are connected electrically by a conductive wire (not shown).

At the end portion on the side of the first rod-shaped core 20A, close to which the second rod-shaped core 20B is arranged, there is provided a flange portion 22A (22) and at the end portion on the side of the second rod-shaped core 20B, close to which the first rod-shaped core 20A is arranged, there is provided a flange portion 22B (22). Then, between the rod-shaped core 20 and the coil 30, there is arranged an insulation member 40 which electrically insulates between the both members. In addition, the coil 30 is arranged at a portion which is not provided with the flange portion 22 of the rod-shaped core 20 (at a core main-body portion 24) and, is arranged in close relation with the flange portion 22 side along the center axis A1, A2 directions of the rod-shaped cores 20.

The first rod-shaped core 20A and the second rod-shaped core 20B are arranged such that the end surface 26A on the side of the first rod-shaped core 20A, close to which the second rod-shaped core 20B is arranged, and the end surface 26B on the side of the second rod-shaped core 20B, close to which the first rod-shaped core 20A is arranged, will be spaced. In addition, the first rod-shaped core 20A and the second rod-shaped core 20B are arranged such that the center axis A1 of the first rod-shaped core 20A and the center axis A2 of the second rod-shaped core 20B will be coincide with each other. Further, the outer circumferential surface 30S of the coil 30 is positioned on the inner circumferential side compared with the outer circumferential surface 22S of the flange portion 22.

It should be noted in FIG. 1 that excluding the configuration in which the first rod-shaped core 20A and the second rod-shaped core 20B have different arrangement-positions and different arrangement-directions in the inside of the antenna device 10A, the shapes and sizes thereof are identical. Also the first coil 30A and the second coil 30B have the same shapes and sizes of the cores.

In addition, the first rod-shaped core 20A, the second rod-shaped core 20B, the first coil 30A and the second coil 30B are housed in the inside of a bottomed tubular case 50A (50) which is provided with an opening portion 52 at one end thereof and provided with a bottom wall portion 54A at the other end thereof. This opening portion 52 is sealed by a plate-shaped lid member 60. Then, on the opening portion 52 side of the tubular case 50A, the first rod-shaped core 20A is positioned, and on the bottom wall portion 54A side thereof, the second rod-shaped core 20B is positioned.

At the position facing the outer circumferential surface of the end portion positioned on the opposite side from the side close to which the flange portion 22B of the second rod-shaped core 20B is provided, there is arranged a metal terminal 70. This metal terminal 70 is connected to the first coil 30A and the second coil 30B by a conductive wire (not shown). One end of this metal terminal 70 thereof penetrates the bottom wall portion 54A and is exposed to the surface positioned opposite to the side, close to which the second rod-shaped core 20B of the bottom wall portion 54A is provided. Then, the one end of the metal terminal 70 is connected to an outside connection terminal 80. In addition, the metal terminal 70 is connected appropriately with an electronic element such as a chip capacitor or the like (not shown). Further, on the occasion of manufacturing the antenna device 10A, if necessary, it is allowed for the gap portion in the tubular case 50A to be filled with a filler formed by curing a potting material (for example, with silicone rubber or the like) which is filled in the inside of the tubular case 50A.

There is no limitation in particular for the cross-sectional shape on the cross-sectional surface (YZ plane-surface) which is orthogonal to the center axes A1, A2 of the rod-shaped cores 20 and it is possible to exemplify, for example, a circular shape, a rectangular shape, a hexagonal shape, an octagonal shape and so on, in which it is preferable to employ a rectangular shape. In addition, it is allowed to employ similar shapes for the cross-sectional shape of the flange portion 22 and the cross-sectional shape of the core main-body portion 24 and it is also allowed to employ non-similar shapes for them. In addition, there is no limitation in particular for the cross-sectional shape (contour shape) of the inner circumferential surface 50S of the tubular case 50 when the tubular case 50 is cut by a plane-surface orthogonal with respect to the center axis thereof and it is possible to exemplify, for example, a circular shape, a rectangular shape, a hexagonal shape, an octagonal shape and so on, in which it is possible to appropriately select the shape corresponding to the cross-sectional shape of the rod-shaped core 20 which is housed inside the tubular case 50. Here, when the cross-sectional shapes of the inner circumferential surface 50S of the tubular case 50 and the flange portion 22 are rectangular shapes, it is possible to cite a cross-sectional structure shown in FIG. 2 as one example of the cross-sectional structure of the antenna device 10A shown in FIG. 1.

In the example shown in FIG. 2, there is arranged the flange portion 22A (whose cross-sectional shape is rectangular) of the first rod-shaped core 20A in the inside of the tubular case 50A whose inner circumferential surface 50S has a rectangular cross-sectional shape. Here, the outer circumferential surfaces 22S of the flange portion 22A are constituted by four plane-surfaces, in which within the outer circumferential surfaces 22S, two areas (plane-surfaces) orthogonal to the Y-axis (first direction) constitute an upper surface 22ST and a lower surface 22SB respectively and within the outer circumferential surfaces 22S, the areas (plane-surfaces) orthogonal to the Z-axis (second direction) constitute a right surface 22SR and a left surface 22SL respectively.

In addition, also the inner circumferential surfaces 50S of the tubular case 50A are constituted by four plane-surfaces, in which within the inner circumferential surfaces 50S, two plane-surfaces orthogonal to the Y-axis (first direction) constitute an upper surface 50ST and a lower surface 50SB respectively and within the inner circumferential surfaces 50S, the plane-surfaces orthogonal to the Z-axis (second direction) constitute a right surface 50SR and a left surface 50SL respectively.

Then, the entire surface of the upper surface 22ST of the flange portion 22A is in close contact with the upper surface 50ST of the tubular case 50A and the entire surface of the lower surface 22SB of the flange portion 22A is in close contact with the lower surface 50SB of the tubular case 50A. On the other hand, the entire surface of the right surface 22SR of the flange portion 22A is spaced from the right surface 50SR of the tubular case 50A and the entire surface of the left surface 22SL of the flange portion 22A is spaced from the left surface 50SL of the tubular case 50A. More specifically, there exists gaps between the flange portion 22A and the tubular case 50A in the Z-axis (second direction). These configurations are similar also with regard to the flange portion 22B of the second rod-shaped core 20B.

It should be noted that the rod-shaped core 20 is constituted by a magnetic material and it is possible to appropriately use such as, for example, a member which is produced by compression-molding fine powders of a Mn—Zn based ferrite or an amorphous-based magnetic body other than that ferrite. In addition, the conductive wire constituting the coil 30 or the like is a member which includes a core wire composed of such a conductive material as copper or the like and an insulation material covering the surface of that core wire, and it is possible for the metal terminal 70 and the external connection terminal 80 to appropriately utilize a member composed of such a conductive member as copper or the like. Further, for the tubular case 50 and the lid member 60, members composed of resin materials are used and it is possible for those members to use members which are injection-molded by using, for example, PP (polypropylene). In addition, it is possible for the insulation member 40 to use a paper, an insulation sheet such as a resin film of a polyester film or the like, or a tubular resin member.

For the antenna device 10A of the present exemplified embodiment which is illustrated in FIGS. 1 and 2, there sometimes occur the following phenomena (1), (2), or the like at the time of manufacturing the antenna device 10A and/or in the finished-product state thereof: (1) the distance (gap length G) between the end surface 26A of the first rod-shaped core 20A and the end surface 26B of the second rod-shaped core in the X-axis direction will fluctuate with respect to its designed value, and (2) the center axis A1 of the first rod-shaped core 20A and the center axis A2 of the second rod-shaped core 20B in the YZ plane-surface direction will be positionally-deviated (axially misaligned). This is because it is possible for the two rod-shaped cores 20, which are inserted into and arranged in the inside of the tubular case 50A, to slide toward the X-axis direction or the Z-axis direction at the time of manufacturing the antenna device 10A shown in FIGS. 1 and 2.

For example, at the time of manufacturing the antenna device 10A, it is assumed that the gap length G is set to be a designed value and it is also assumed that the rod-shaped core 20 is arranged in the inside of the tubular case 50A so as to have absolutely no axial misalignment. (a) However, even in this case, unless the rod-shaped cores 20 are completely fixed in the inside of the antenna device 10A, there is a possibility that the gap length G will fluctuate or the axial misalignment will occur by an impact is added to the antenna device 10A from the outside during the assembly thereof (b) In addition, when after arranging the rod-shaped cores 20 in the inside of the tubular case 50A at the time of the manufacturing, the antenna device 10A is completed without completely fixing the arrangement position of the rod-shaped core 20 by using a potting material or the like, there is a possibility that the gap length G will fluctuate or the axial misalignment will occur because an impact is added from the outside to the antenna device 10A in a finished product state. Therefore, in the cases shown in the abovementioned (a) and (b), it happens that the inductance-value L of the antenna device 10A will fluctuate with respect to the designed value because there occurs the fluctuation of the gap length G or the axial misalignment.

In order to suppress such a fluctuation of the inductance-value L, such as, for example, the antenna device which was exemplified in the Patent Document 1 (Japanese unexamined patent publication No. 2007-43588), it is effective to provide a small-sized core as an inductance-value adjusting mechanism for adjusting the inductance-value L between the serially arranged two rod-shaped cores. However, in this case, the structure of the antenna device becomes complicated and therefore, that device lacks in practicability with regard to the cost and the productivity thereof. On the contrary, according to the antenna device 10 of the present exemplified embodiment, even if the gap length G fluctuates, the axial misalignment occurs, or the like, it is possible to suppress the fluctuation of the inductance-value L even without employing an inductance-value adjusting mechanism. Hereinafter, there will be explained the reason for obtaining such an effect.

Figure 3:
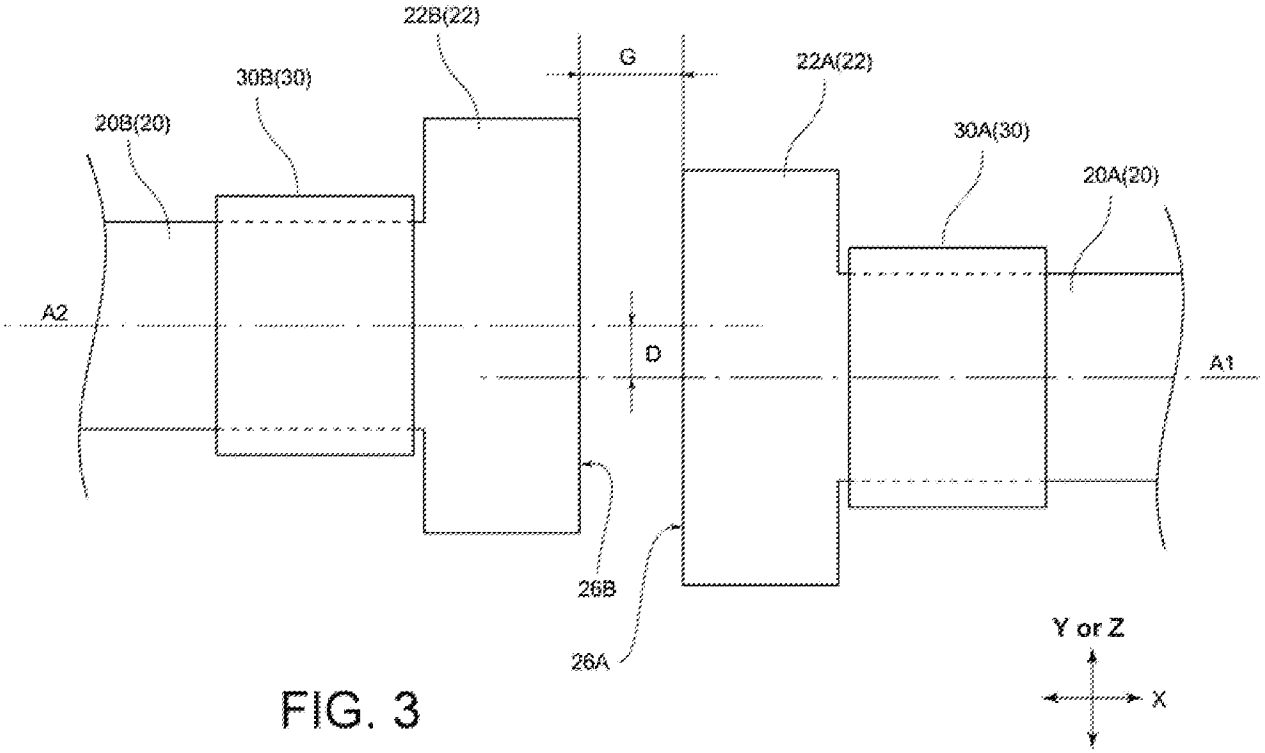
FIG. 3 is a schematic view showing a structure with regard to a main portion of an antenna device of the present exemplified embodiment.
Figure 4:
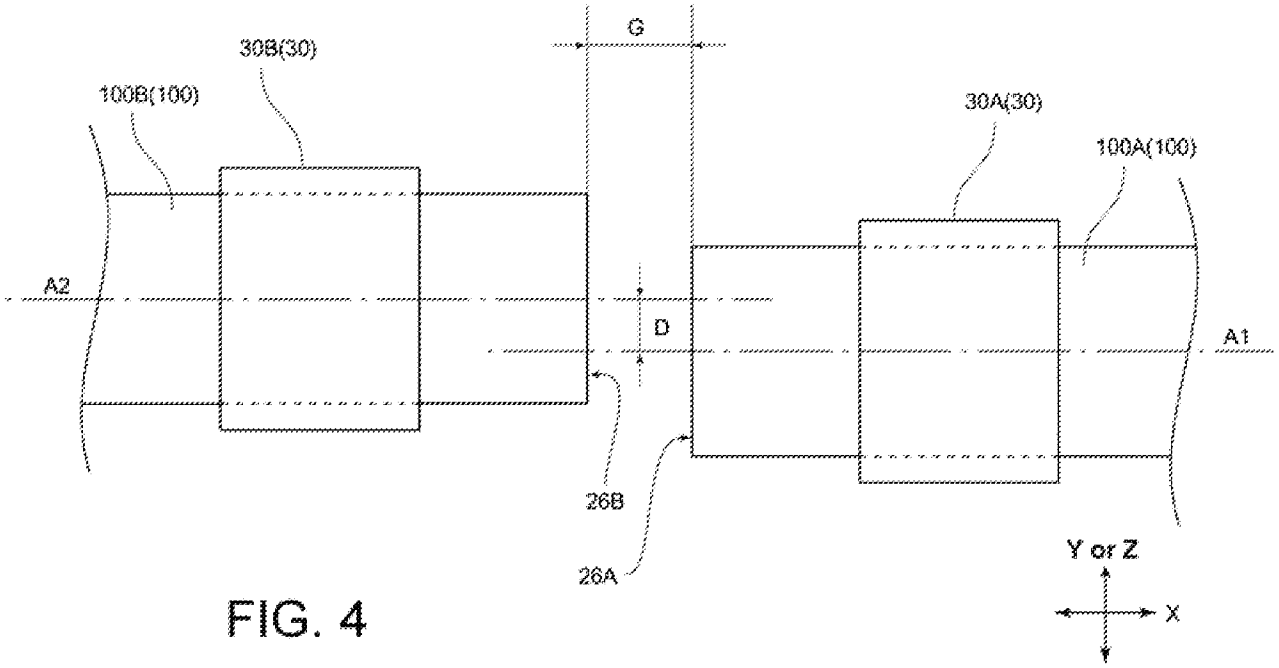
FIG. 4 is a schematic view showing a structure with regard to a case in which a rod-shaped core without a flange is used instead of the rod-shaped core with a flange shown in FIG. 3.

FIG. 3 is a schematic view showing a structure with regard to a main portion of the antenna device 10 of the present exemplified embodiment, and FIG. 4 is a schematic view showing a structure with regard to a case in which a rod-shaped core without a flange is used instead of the rod-shaped core with a flange shown in FIG. 3. It should be noted in FIGS. 3 and 4 that there are omitted the descriptions with regard to the members other than the rod-shaped cores 20, 100 and the coils 30. In addition, the different-configuration between the example shown in FIG. 3 and the example shown in FIG. 4 lies only in a difference whether or not the rod-shaped core has a flange portion. More specifically, the first rod-shaped core 100A (100) and the second rod-shaped core 100B (100) shown in FIG. 4 respectively correspond to the first rod-shaped core 20A and the second rod-shaped core 20B shown in FIG. 3, in which except the configuration that there are no flange portions 22 included, the cores thereof have identical shapes, sizes and material properties as those of the rod-shaped cores 20 shown in FIG. 3. It should be noted that the numeral D in the drawings means a distance (axial misalignment-length D) between the center axis A1 and the center axis A2 in the YZ plane-surface direction.

Here, supposing that there is no limitation at all for the movements of the rod-shaped cores 20, 100 toward the X-axis direction and toward the YZ plane-surface direction in FIGS. 3 and 4, there were carried out simulation-calculations out with regard to the inductance-value L in case of changing the gap length G and the axial misalignment-length D variously. These simulation-results are shown in Table-1 and Table-2. It should be noted that Table-1 indicates the results of the simulation-calculations with regard to the example shown in FIG. 3, and Table-2 indicates the results of the simulation-calculations with regard to the example shown in FIG. 4. The value of the inductance-value L in Table-1 and Table-2 indicates a relative value (%) when the inductance-value L, under a condition of "measured current=1 mA, gap length G=0.00 mm and also axial misalignment-length D=0.00 mm", is made to be a reference value (100%).

TABLE-1

| | | Gap-Length G (mm) | | | | |
|---|---|---|---|---|---|---|
| | | 0.00 mm | 0.25 mm | 0.50 mm | 1.0 mm | 1.50 mm |
| Axial | 0.00 mm | 100.00% | 93.92% | 90.40% | 84.36% | 80.58% |
| Misalignment- | 0.25 mm | 99.75% | 93.99% | 90.19% | 84.54% | 79.82% |
| Length D | 0.50 mm | 99.64% | 93.95% | 89.67% | 83.89% | 80.18% |
| (mm) | 1.0 mm | 99.61% | 93.89% | 89.31% | 83.66% | 80.14% |
| | 1.50 mm | 98.95% | 93.37% | 88.87% | 83.43% | 79.82% |

TABLE-2

| | | Gap-Length G (mm) | | | | |
|---|---|---|---|---|---|---|
| | | 0.00 mm | 0.25 mm | 0.50 mm | 1.0 mm | 1.50 mm |
| Axial Misalignment-Length D (mm) | 0.00 mm | 100.00% | 86.70% | 79.49% | 71.75% | 67.55% |
| | 0.25 mm | 99.73% | 86.39% | 79.06% | 71.49% | 67.48% |
| | 0.50 mm | 99.27% | 85.88% | 78.79% | 71.39% | 67.30% |
| | 1.0 mm | 99.56% | 85.71% | 78.35% | 71.13% | 67.08% |
| | 1.50 mm | 99.20% | 84.53% | 77.59% | 70.43% | 66.41% |

As clear from the results shown in Table-1 and Table-2, in case of using the rod-shaped core 20 having the flange portion 22, it is possible to suppress the fluctuation-amount of the inductance-value L compared with a case in which a general rod-shaped core 100 having no flange portion 22 and having a straight shape even if the gap length G fluctuates, even if he axial misalignment-length D fluctuates, or the like. It is conceivable that this reason is because the magnetic flux extending from the coil 30A to the end surface 26A of the first rod-shaped core 20A and the magnetic flux extending from the coil 30B to the end surface 26B of the second rod-shaped core 20B can be suppressed from leaking toward the outside direction of the rod-shaped core 20 by means of the flange portion 22 even if the gap length G or the axial misalignment-length D increases.

Therefore, according to the antenna device 10 of the present exemplified embodiment, it is possible to suppress the fluctuation of the inductance-value L even in the cases shown in the following cases (1) and (2) which include structures in which the fluctuation of the gap length G or the axial misalignment occurs easily:

(1) at the time of manufacturing the antenna device 10 and after finishing the arrangement of the first rod-shaped core 20A and the second rod-shaped core 20B in the inside of the tubular housing member (for example, tubular case 50A exemplified in FIG. 1, bobbin or the like) which houses at least those cores, when at least one rod-shaped core 20 which is selected from the first rod-shaped core 20A and the second rod-shaped core 20B is slidable in the tubular housing member, and (2) after the completion of the antenna device 10, when at least one rod-shaped core 20 which is selected from the first rod-shaped core 20A and the second rod-shaped core 20B is slidable in the tubular housing member.

It should be noted in the present specification that the "tubular housing member" means a tubular member which directly houses the first rod-shaped core 20A and the second rod-shaped core 20B. Therefore, when the antenna device 10 includes a first tubular body for housing the first rod-shaped core 20A and the second rod-shaped core 20B on the inner circumferential side thereof and includes a second tubular body for housing the first tubular body on the inner circumferential side thereof, the "tubular housing member" means only the first tubular body. If explained by citing an embodiment, for the antenna device 10A shown in FIG. 1, the tubular case 50A corresponds to the tubular housing member. In addition, when for the antenna device 10 of the present exemplified embodiment, there is included a bobbin which houses the first rod-shaped core 20A and the second rod-shaped core 20B in the inner circumferential side thereof and which is provided with the first coil 30A and the second coil 30B on the outer circumferential side thereof; and there is included a tubular case which houses the bobbin on the inner circumferential side thereof, the bobbin does correspond to the tubular housing member.

Here, for an embodiment of the antenna device 10 having a structure in which the gap length G may fluctuate, for example, it can be when at least the first rod-shaped core 20A and the second rod-shaped core 20B are housed inside the tubular housing member, the inside of the space (gap space S) formed between the end surface 26A of the first rod-shaped core 20A and the end surface 26B of the second rod-shaped core 20B is occupied by a material selected from any one of the following members of (i) to (iv), that is, (i) a material composed of only gas, (ii) a material containing gas and liquid substance, (iii) a material containing gas and fine solid substance, (iv) a material containing gas and sponge-like substance. Here, for the gas in (i) to (iv), it can be air or the like, (ii) for the liquid substance, it can be grease or the like, and (iii) for the fine solid substance, it can be a particulate material having a maximum diameter equal to or less than a fraction of the gap length G or it can be a fibrous material (pulp fiber, glass fiber, cotton fiber or the like) having a maximum length equal to or less than a fraction of the gap length G. It should be noted in (ii) to (iv) that it is enough if the ratio of the gas occupying the inside of the gap space S is 20% or more, in which 50% or more is preferable.

For example, for the antenna device 10A shown in FIG. 1, the first rod-shaped core 20A and the second rod-shaped core 20B are housed in the inside of the tubular housing member (tubular case 50A) together with the first coil 30A and the second coil 30B. Then, for the antenna device 10A, only air exists in the inside of the gap space S. For this reason, for the antenna device 10A shown in FIG. 1, either one of the first rod-shaped core 20A and the second rod-shaped core 20B can slide toward the X-axis direction and therefore, the gap length G may fluctuate.

In addition, when at least the first rod-shaped core 20A and the second rod-shaped core 20B are housed in the inside of the tubular housing member, for an embodiment of the antenna device 10 having a structure in which an axial misalignment may occur, it is possible to cite such a case in which the entire surface of at least one area selected from the following areas of (i) to (iv) is spaced from the inner circumferential surface of the tubular housing member: (i) an area, within the outer circumferential surfaces 22S of the flange portion 22A of the first rod-shaped core 20A, which is orthogonal to the Y-axis direction (first direction); (ii) an area, within the outer circumferential surfaces 22S of the flange portion 22A of the first rod-shaped core 20A, which is orthogonal to the Z-axis direction (second direction); (iii) an area, within the outer circumferential surfaces 22S of the flange portion 22B of the second rod-shaped core, which is orthogonal to the Y-axis direction (first direction); and (iv) an area, within the outer circumferential surfaces 22S of the flange portion 22B of the second rod-shaped core 20B, which is orthogonal to the Z-axis direction (second direction). It should be noted in the present specification that the wording "the inner circumferential surface of the tubular housing member" includes a surface of a protrusion which is formed on the inner circumferential side of the tubular housing member so as to form a unity with the tubular housing member and a surface of a protrusion which is fixed on the inner circumferential side of the tubular housing member firmly by adhesion or the like.

For example, for the antenna device 10A shown in FIGS. 1 and 2, the first rod-shaped core 20A and the second rod-shaped core 20B are housed in the inside of the tubular housing member (tubular case 50A) together with the first coil 30A and the second coil 30B. Then, for the antenna device 10A, the entire surface of (ii) the area (right surface 22SR), within the outer circumferential surfaces 22S of the flange portion 22A of the first rod-shaped core 20A, which is orthogonal to the Z-axis direction (second direction); and the entire surface of (iv) the area (right surface 22SR), within the outer circumferential surfaces 22S of the flange portion 22B of the second rod-shaped core 20B, which is orthogonal to the Z-axis direction (second direction) are spaced from the inner circumferential surface 50S of the tubular housing member (tubular case 50A). For this reason, for the antenna device 10A shown in FIGS. 1 and 2, either one of the first rod-shaped core 20A and the second rod-shaped core 20B can slide in the Z-axis direction and therefore, there is a possibility that the axial misalignment will occur.

As explained above, in the antenna device 10 of the present exemplified embodiment, there are used the rod-shaped cores 20 including the two flange portions 22 and therefore, it is possible to suppress the fluctuation of the inductance value, which happens when the gap length G fluctuates or the axial misalignment occurs, or the like because the rod-shaped cores 20 slide toward unintended directions in the inside of the antenna device 10.

On the other hand, the rod-shaped core 20 used for the antenna device 10 of the present exemplified embodiment includes the flange portion 22 which forms a protruding portion with respect to the columnar-shaped core main-body portion 24. For this reason, by providing, on the tubular housing member, a restriction portion for restricting the slide of the rod-shaped core 20 in the inside of the antenna device 10 by being locked, fitted or the like with respect to the flange portion 22 which forms a protruding portion, it is very easy also to prevent the rod-shaped core 20 from sliding toward an unintended direction. In this case, it is possible to fundamentally suppress at least either one of the fluctuation of the gap length G and the axial misalignment, which is the cause for inviting the fluctuation of the inductance-value L. Therefore, in case of providing a restriction portion, for restricting the slide of the rod-shaped core 20, at the tubular housing member, it is possible to completely suppress the fluctuation of the inductance-value L, which is caused by at least either one of the fluctuation of the gap length G and the axial misalignment.

Figure 5:
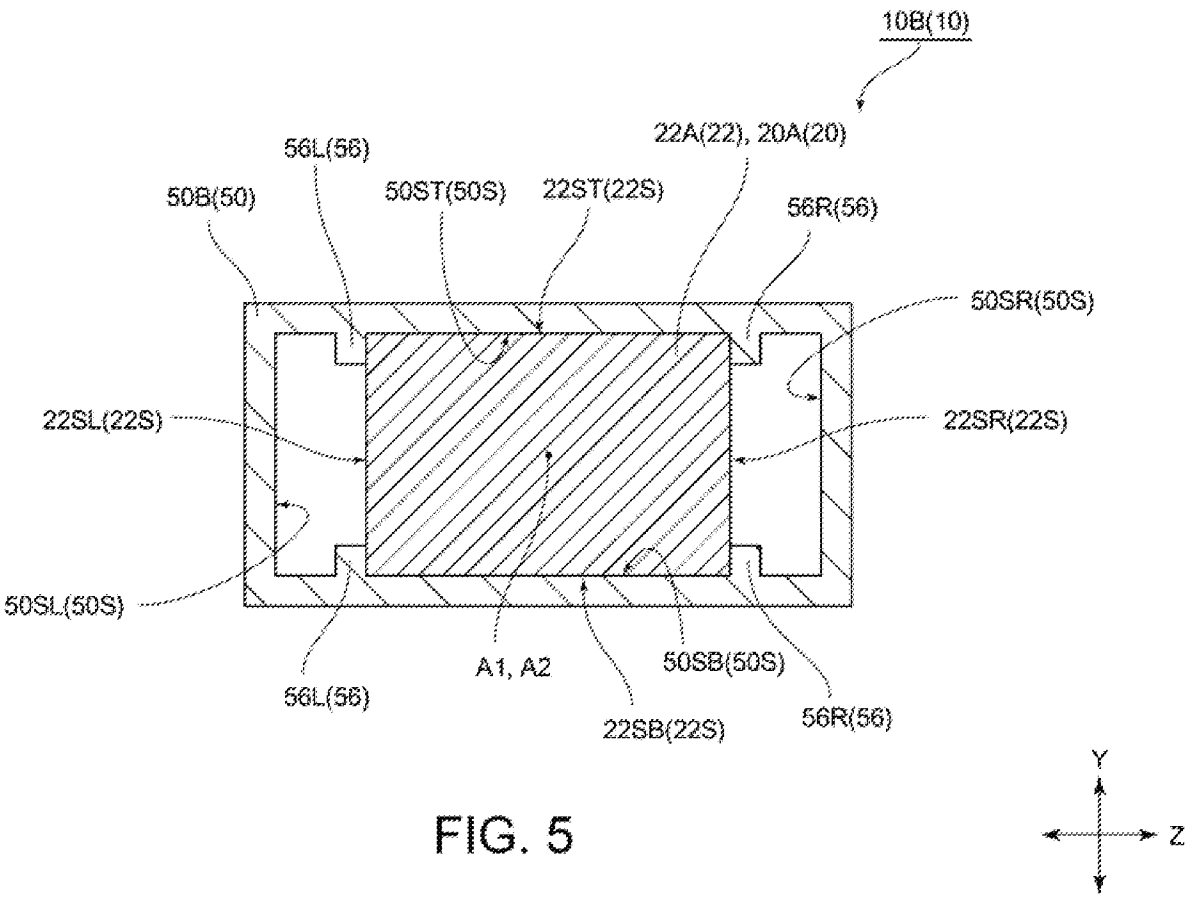
FIG. 5 is a schematic cross-sectional view (YZ cross-sectional view) showing another example of the antenna device of the present exemplified embodiment.

FIG. 5 is a schematic cross-sectional view showing another example of the antenna device 10 of the present exemplified embodiment and specifically, is a view (YZ cross-sectional view) showing a modified example of the antenna device 10A shown in FIG. 2. The antenna device 10B (10) shown in FIG. 5 is a device having similar shape and structure as those of the antenna device 10A shown in FIG. 1 excepting an aspect that the internal structure of the tubular case 50 is a little bit different. For the antenna device 10B shown in FIG. 5, there is arranged the flange portion 22A (having a rectangular cross-sectional shape) of the first rod-shaped core 20A in the inside of the tubular case 50B (50), in which the cross-sectional shape of the inner circumferential surface 50S is rectangular. Then, the tubular case 50B shown in FIG. 5 is a member having similar shape and size as those of the tubular case 50A shown in FIG. 2 other than the configuration that there are provided four protrusions 56 which are formed on the inner circumferential surface 50S integrally with the tubular case 50B.

Here, for the tubular case 50B, there are provided a pair of protrusions 56L, 56R on the upper surface 50ST and there are provided a pair of protrusions 56L, 56R also on the lower surface 50SB. In addition, the interval between the protrusion 56L and the protrusion 56R which form one pair is in conformity with the width (length in the Z-axis direction) of the flange portion 22. It should be noted for the neighboring two protrusions 56 that the "interval" between the two protrusions means the minimum distance between the end surface of one protrusion 56 on the side close to which the other protrusion 56 is provided and the end surface of the other protrusion 56 on the side close to which the one protrusion 56 is provided. Then, there is arranged the flange portion 22A of the first rod-shaped core 20A so as to be positioned between the two protrusions 56L, 56R which are provided on the upper surface 50ST and between the two protrusions 56L, 56R which are provided on the lower surface 50SB. It should be noted that this configuration is similar for the second rod-shaped core 20B which is not shown in FIG. 5.

For this reason, differently from the antenna device 10A shown in FIG. 2 in which there is a possibility that an unintentional slide of the first rod-shaped core 20A and the second rod-shaped core 20B may occur toward the Z-axis direction, the antenna device 10B shown in FIG. 5 is further prevented from also the unintentional slide of the first rod-shaped core 20A and the second rod-shaped core 20B toward the Z-axis direction. More specifically, the axial misalignment does not occur for the antenna device 10B shown in FIG. 5 and therefore, the fluctuation-amount of the inductance-value L, which is caused by the axial misalignment, can be made to be zero.

The antenna device 10 having a structure in which it is possible to prevent the occurrence of the axial misalignment is not limited by the antenna device 10B exemplified in FIG. 5, and it is enough if the following conditions are satisfied. More specifically, for the antenna device 10 having a structure in which it is possible to prevent the occurrence of the axial misalignment, it can be, for example, when there are housed at least the first rod-shaped core 20A and the second rod-shaped core 20B inside the tubular housing member, the following portions of (i) to (iv) are in close contact with the inner circumferential surfaces of the tubular housing member: (i) at least a portion of the area, within the outer circumferential surfaces 22S of the flange portion 22A of the first rod-shaped core 20A, which is orthogonal to the Y-axis direction (first direction); (ii) at least a portion of the area, within the outer circumferential surfaces 22S of the flange portion 22A of the first rod-shaped core 20A, which is orthogonal to the Z-axis direction (second direction); (iii) at least a portion of the area, within the outer circumferential surfaces 22S of the flange portion 22B of the second rod-shaped core 20B, which is orthogonal to the Y-axis direction (first direction); and (iv) at least a portion of the area, within the outer circumferential surfaces 22S of the flange portion 22B of the second rod-shaped core 20B, which is orthogonal to the Z-axis direction (second direction).

For example, for the example shown in FIG. 5, (i) the entire surfaces of the areas (upper surface 22ST and lower surface 22SB), within the outer circumferential surface 22S of the flange portion 22A of the first rod-shaped core 20A, which is orthogonal to the Y-axis direction (first direction), are in close contact with the inner circumferential surfaces 50S (upper surface 50ST and lower surface 50SB) of the tubular case 50B (tubular housing member). In addition, (ii) at least the portions (vicinities on the sides of the both ends of left surface 22SL and right surface 22SR in the Y-axis direction) of the areas (left surface 22SL and right surface 22SR), within the outer circumferential surfaces 22S of the flange portion 22A of the first rod-shaped core 20A, which is orthogonal to the Z-axis direction (second direction), are in close contact with the portions of the surfaces of the protrusions 56L, 56R constituting the portions of the inner circumferential surfaces 50S of the tubular case 50B (tubular housing member). Then, with regard to (i) and (ii), there is employed a similar configuration also with regard to the second rod-shaped core 20B whose illustration is omitted in FIG. 5.

Figure 6:
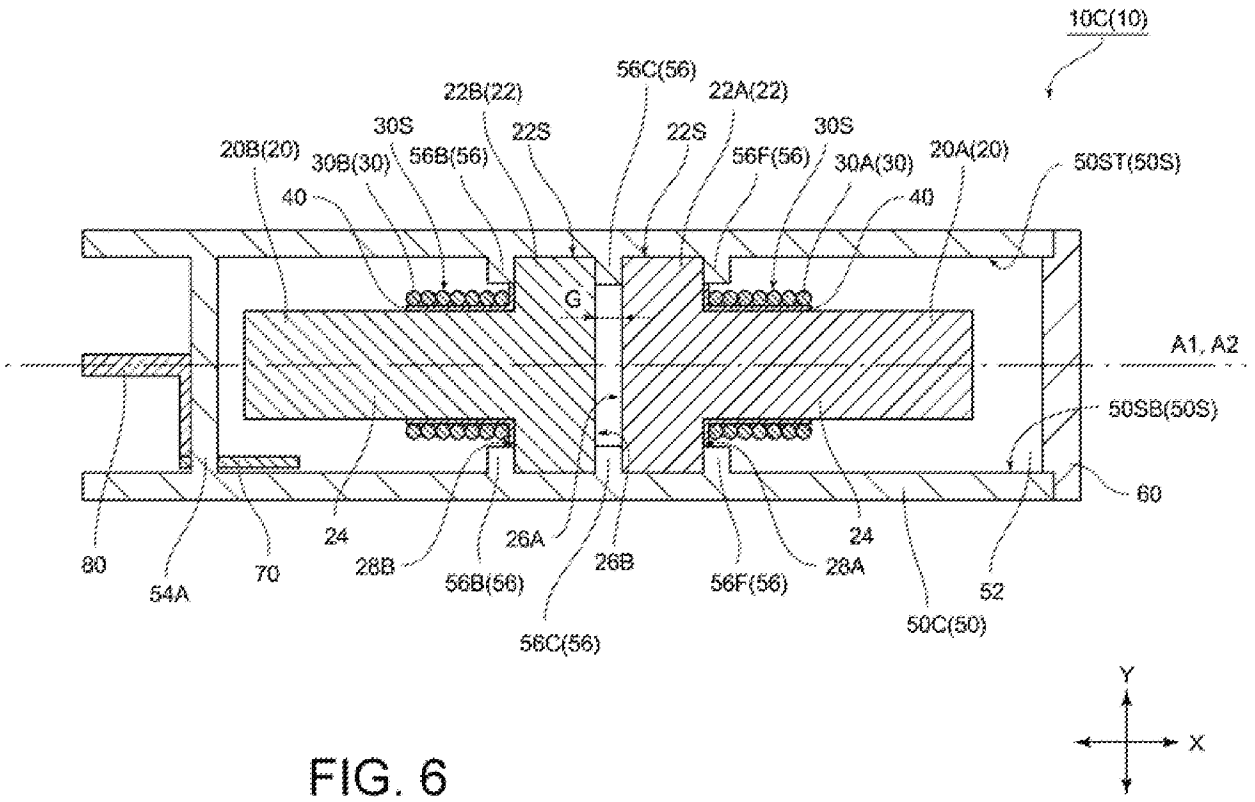
FIG. 6 is a schematic cross-sectional view (XY cross-sectional view) showing another example the antenna device of the present exemplified embodiment.

FIG. 6 is a schematic cross-sectional view showing another example of the antenna device 10 of the present exemplified embodiment and specifically, is a view (XY cross-sectional view) showing a modified example of the antenna device 10A shown in FIG. 1. The antenna device 10C (10) shown in FIG. 6 is a device having similar shape and structure as those of the antenna device 10A shown in FIG. 1 excepting an aspect that the internal structure of the tubular case 50 is a little bit different. The tubular case 50C which constitutes the antenna device 10C shown in FIG. 6 is a member having similar shape and size as those of the tubular case 50A shown in FIG. 1 other than the configuration that there are provided six protrusions 56 which are formed on the inner circumferential surface 50S integrally with the tubular case 50C.

Here, for the tubular case 50C, there are provided protrusions 56F, protrusions 56C and protrusions 56B in this order on the upper surface 50ST and the lower surface 50SB of the inner circumferential surface 50S of the tubular case 50C from one end side of the tubular case 50C to the other end side thereof. In addition, the interval between the protrusion 56F and the protrusion 56C is in conformity with the length (length in the X-axis direction) of the flange portion 22A and the interval between the protrusion 56C and the protrusion 56B is in conformity with the length (length in the X-axis direction) of the flange portion 22B. Then, there is arranged the flange portion 22A of the first rod-shaped core 20A so as to be positioned between the two protrusions 56F, 56C provided on the upper surface 50ST and between the two protrusions 56F, 56C provided on the lower surface 50SB. In addition, there is arranged the flange portion 22B of the second rod-shaped core 20B so as to be positioned between the two protrusions 56C, 56B provided on the upper surface 50ST and between the two protrusions 56C, 56B provided on the lower surface 50SB.

For this reason, differently from the antenna device 10A shown in FIG. 1 in which there is a possibility that an unintentional slide of the first rod-shaped core 20A and the second rod-shaped core 20B may occur toward the X-axis direction, for the antenna device 10C shown in FIG. 6, it is possible to prevent the unintentional slide of the first rod-shaped core 20A and the second rod-shaped core 20B toward the X-axis direction. More specifically, the fluctuation of the gap length G does not occur for the antenna device 10C shown in FIG. 6 and therefore, the fluctuation-amount of the inductance-value, which is caused by the fluctuation of the gap length G, can be made to be zero. In addition, for the antenna device 10C, it is possible to set the gap length G as a desired value by changing the width (length in the X-axis direction) of the protrusion 56C.

It should be noted that even if a partition plate or an adhesive-agent layer is provided instead of the protrusion 56C shown in FIG. 6, similarly as the antenna device 10C shown in FIG. 6, it is possible to prevent the unintentional slide of the first rod-shaped core 20A and the second rod-shaped core 20B toward the X-axis direction.

Figure 7:
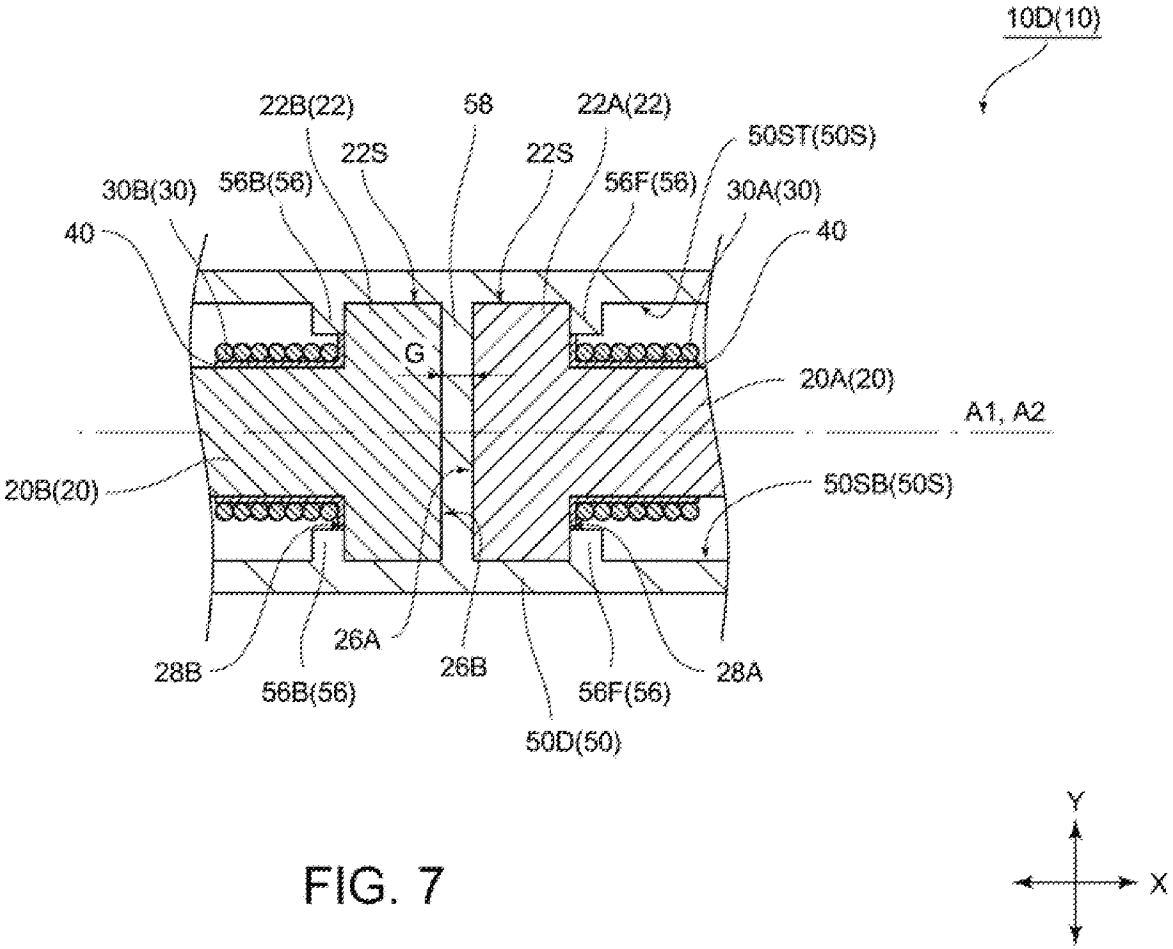
FIG. 7 is a partial cross-sectional view (XY cross-sectional view) showing another example of the antenna device of the present exemplified embodiment.

FIG. 7 is a partial cross-sectional view showing another example of the antenna device 10 of the present exemplified embodiment and specifically, is a view (XY cross-sectional view) showing a modified example of the antenna device 10C shown in FIG. 6. The antenna device 10D (10) shown in FIG. 7 is a device having similar shape and structure as those of the antenna device 10C shown in FIG. 6 excepting an aspect that the internal structure of the tubular case 50 is a little bit different. The tubular case 50D (50) which constitutes the antenna device 10D shown in FIG. 7 is a member having similar shape and structure as those of the tubular case 50C shown in FIG. 6 excepting an aspect that there is provided a partition plate 58, which is formed integrally with the tubular case 50C, instead of the protrusion 56C in the tubular case 50C shown in FIG. 6. In addition, the thickness (length in the X-axis direction) of the partition plate 58 shown in FIG. 7 is identical with the width (length in the X-axis direction) of the protrusion 56C shown in FIG. 6.

Therefore, the interval between the protrusion 56F and the partition plate 58 is in conformity with the length (length in the X-axis direction) of the flange portion 22A and the interval between the partition plate 58 and the protrusion 56B is in conformity with the length (length in the X-axis direction) of the flange portion 22B. Then, there is arranged the flange portion 22A of the first rod-shaped core 20A so as to be positioned between the two protrusions 56F, which are provided respectively on the upper surface 50ST and the lower surface 50SB, and the partition plate 58. In addition, there is arranged the flange portion 22B of the second rod-shaped core 20B so as to be positioned between the protrusions 56B, which are provided respectively on the upper surface 50ST and the lower surface 50SB, and the partition plate 58.

As exemplified in FIGS. 6 and 7, in order to prevent the fluctuation of the gap length G, it is possible for the antenna device 10 of the present exemplified embodiment to provide three members shown in the followings (A) to (C) on the inner circumferential side of the tubular housing member:

(A) Either one of the members selected from the following (A1) and (A2): (A1) the partition plate 58 which is in close contact with the end surface 26A on the side of the first rod-shaped core 20A, close to which the second rod-shaped core 20B is arranged and in close contact with the end surface 26B on the side of the second rod-shaped core 20B, close to which the first rod-shaped core 20A is arranged, and (A2) the protrusion 56C which is in close contact with the end surface 26A on the side of the first rod-shaped core 20A, close to which the second rod-shaped core 20B is arranged and in close contact with the end surface 26B on the side of the second rod-shaped core 20B, close to which the first rod-shaped core 20A is arranged;

(B) The protrusion 56F which is in close contact with the end surface 28A positioned on the opposite side from the side of the flange portion 22A of the first rod-shaped core 20A, close to which the second rod-shaped core 20B is provided; and (C) The protrusion 56B which is in close contact with the end surface 28B positioned on the opposite side from the side of the flange portion 22B of the second rod-shaped core 20B, close to which the first rod-shaped core 20A is provided.

It should be noted that it is preferable for the protrusion 56 and the partition plate 58 to be integrally formed with the tubular housing member, but it is allowed to employ a configuration in which they are fixed firmly on the inner circumferential surface of the tubular housing member by adhesion, by fitting, or the like.

Figure 8:
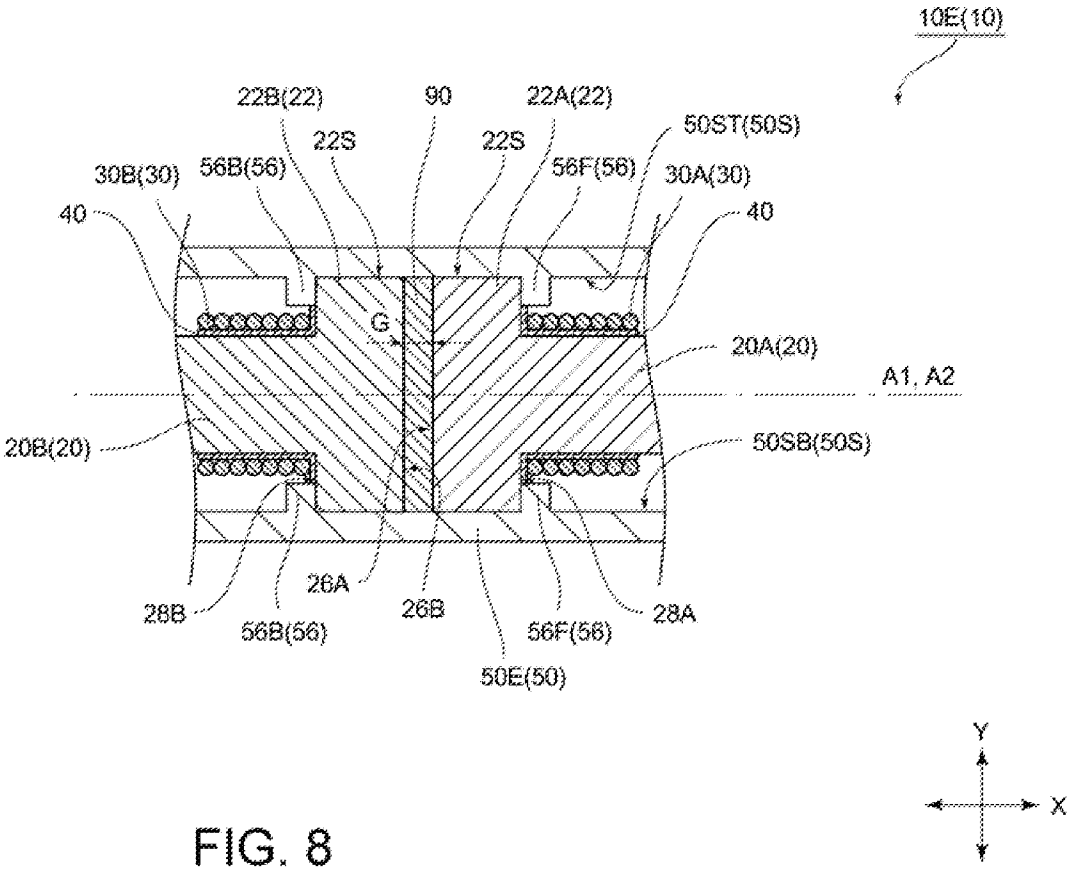
FIG. 8 is a partial cross-sectional view (XY cross-sectional view) showing another example of the antenna device of the present exemplified embodiment.

FIG. 8 is a partial cross-sectional view showing another example of the antenna device 10 of the present exemplified embodiment and specifically, is a view (XY cross-sectional view) showing a modified example of the antenna device 10C shown in FIG. 6. The antenna device 10E (10) shown in FIG. 8 is a device having similar shape and structure as those of the antenna device 10C shown in FIG. 6 excepting an aspect that the internal structure of the tubular case 50 is a little bit different and there is included an adhesive-agent layer 90. The tubular case 50E (50) which constitutes the antenna device 10E shown in FIG. 8 is a member having similar shape and size as those of the tubular case 50C excepting an aspect that the protrusion 56C in the tubular case 50C shown in FIG. 6 is omitted. In addition, the thickness (length in the X-axis direction) of the adhesive-agent layer 90, which bonds the end surface 26A of the first rod-shaped core 20A and the end surface 26B of the second rod-shaped core 20B, is identical with the width (length in the X-axis direction) of the protrusion 56C shown in FIG. 6 and is identical with the thickness (length in the X-axis direction) of the partition plate 58 shown in FIG. 7.

It should be noted for the antenna device 10E shown in FIG. 8 that it is also possible to omit the protrusions 56F, 56B from the tubular case 50E. This is because even in case of omitting the protrusions 56F, 56B, it is possible to always keep the gap length G to be constant caused by the configuration that the first rod-shaped core 20A and the second rod-shaped core 20B are bonded by the adhesive-agent layer 90. However, there is a possibility, in the inside of the tubular case 50E in which the protrusions 56F, 56B are omitted, that the first rod-shaped core 20A and the second rod-shaped core 20B which are bonded by the adhesive-agent layer 90 might slide integrally all together in the X-axis direction. Therefore, in order to prevent such an unintentional slide, it is desirable not to omit the protrusions 56F, 56B.

As exemplified in FIG. 8, in order to prevent the fluctuation of the gap length G, it is possible for the antenna device 10 of the present exemplified embodiment to employ a configuration in which the end surface 26A on the side of the first rod-shaped core 20A, close to which the second rod-shaped core 20B is arranged and the end surface 26B on the side of the second rod-shaped core 20B, close to which the first rod-shaped core 20A is arranged are bonded through the adhesive-agent layer 90. It should be noted that in the example shown in FIG. 8, the adhesive-agent layer 90 having a single layer is used, but it is also possible to use the adhesive-agent layer 90 having two layers. For example, in order to make the adjustment of the gap length G easier, it is possible to employ a configuration in which a plate-shaped spacer having a certain thickness is arranged between the end surface 26A of the first rod-shaped core 20A and the end surface 26B of the second rod-shaped core 20B, and, in which one surface of the spacer and the end surface 26A are bonded by a first adhesive-agent layer 90 and the other surface of the spacer and the end surface 26B are bonded by a second adhesive-agent layer 90.

In addition, for the antenna device 10 of the present exemplified embodiment, it is also possible to prevent the fluctuation of the gap length G by providing a groove for fitting and fixing the flange portion 22 of the rod-shaped core 20 onto the inner circumferential surface 50S of the tubular case 50.

Figure 9:
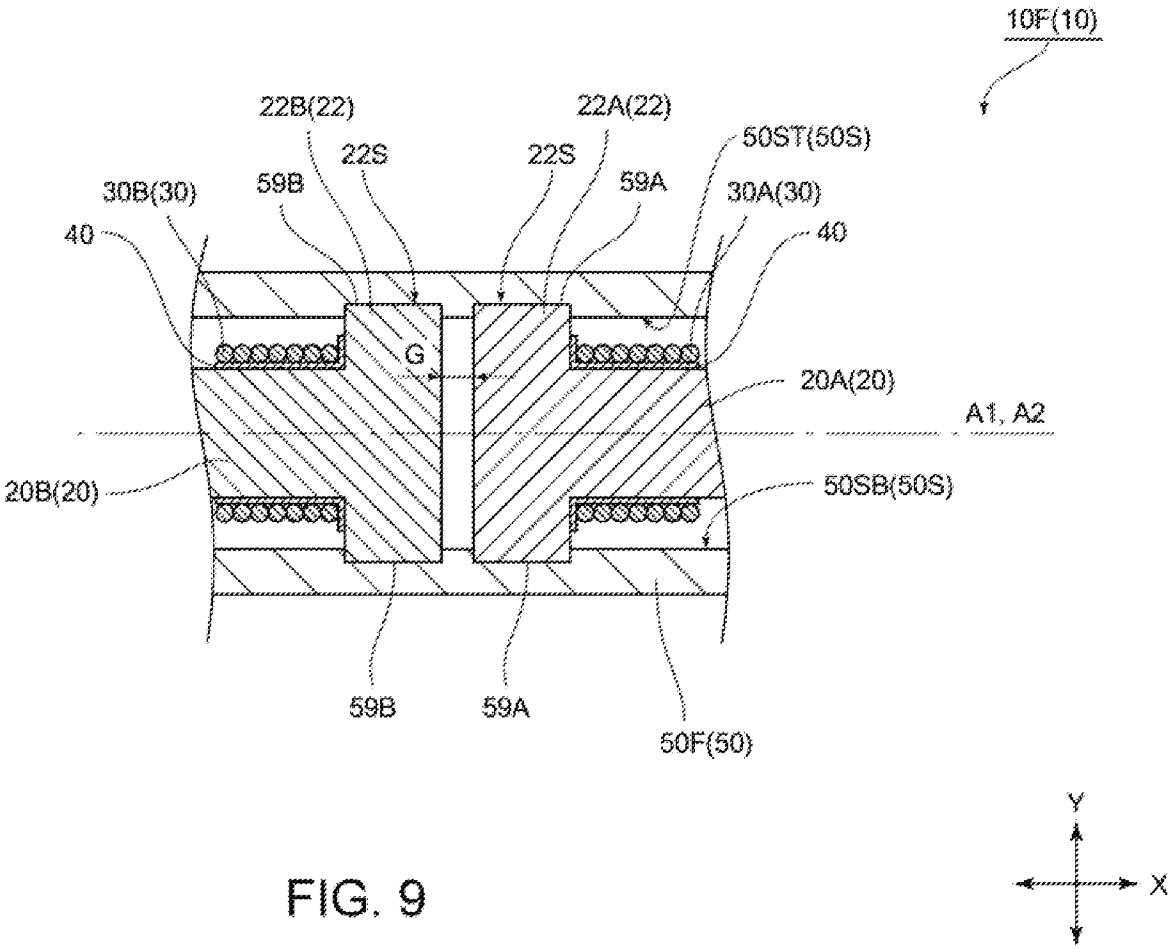
FIG. 9 is a partial cross-sectional view (XY cross-sectional view) showing another example of the antenna device of the present exemplified embodiment.

FIG. 9 is a partial cross-sectional view showing another example of the antenna device 10 of the present exemplified embodiment and specifically, is a view (XY cross-sectional view) showing a modified example of the antenna device 10A shown in FIG. 1. The antenna device 10F (10) shown in FIG. 9 is a device having similar shape and structure as those of the antenna device 10A shown in FIG. 1 excepting an aspect that the internal structure of the tubular case 50 is a little bit different. The tubular case 50F which constitutes the antenna device 10F shown in FIG. 9 is a member having similar shape and size as those of the tubular case 50A shown in FIG. 1 excepting an aspect that after the outer-shell thickness of the tubular case 50A shown in FIG. 1 is made a little bit thicker, there are provided a first groove 59A and a second groove 59B on the inner circumferential surface 50S in a manner of being placed with a space equivalent to the gap length G with respect to the longitudinal direction (X-axis direction) of the tubular case 50F. The widths (lengths in the X-axis direction) of these two grooves 59A, 59B are identical with the widths (lengths in the X-axis direction) of the flange portions 22A, 22B respectively. Then, the circumferential portion of the flange portion 22A of the first rod-shaped core 20A is fitted into the first groove 59A and the circumferential portion of the flange portion 22B of the second rod-shaped core 20B is fitted into the second groove 59B.

As exemplified in FIG. 9, in order to prevent the fluctuation of the gap length G, it is possible for the antenna device 10 of the present exemplified embodiment, to employ a configuration in which there are provided the first groove 59A and the second groove 59B on the inner circumferential side of the tubular housing member so as to be adjacent each other with respect to the longitudinal direction (X-axis direction) of the tubular housing member; in which in the direction (X-axis direction) parallel to the arrangement-direction of the plurality of rod-shaped cores 20, the width of the first groove 59A is identical with the width of the flange portion 22A of the first rod-shaped core 20A and, the width of the second groove 59B is identical with the width of the flange portion 22B of the second rod-shaped core 20B; and in which the circumferential portion of the flange portion 22A of the first rod-shaped core 20A is fitted in the inside of the first groove 59A and also, the circumferential portion of the flange portion 22B of the first rod-shaped core 20B is fitted in the inside of the second groove 59B. It should be noted that it is enough if each of the first groove 59A and the second groove 59B is provided at least for a portion of the circumference in the circumferential direction of the tubular housing member.

For the antenna devices 10C, 10D, 10E or 10F shown in FIGS. 6 to 9 which were explained above, there are provided the protrusions 56, the partition plate 58 or the grooves 59A, 59B on the inner circumferential sides of the tubular cases 50C, 50D, 50E and 50F. For this reason, on the occasion of assembling the antenna device 10C, 10D, 10E or 10F, it is not possible to insert the two rod-shaped cores 20 in the inside of the tubular case 50 along the X-axis direction. Therefore, it is preferable for the tubular case 50C, 50D, 50E or 50F which is used for the assembling of the antenna device 10C, 10D, 10E or 10F shown in FIGS. 6 to 9 to be constituted by a combination of two members which are formed by dividing the tubular case 50C, 50D, 50E or 50F into two pieces with respect to the plane-surface parallel to the X-axis direction (for example, combination of two semi-tubular members, combination of a tubular case main-body whose side surface is opened and of a side-surface lid member, or the like). In this case, on the occasion of assembling the antenna device 10C, 10D, 10E or 10F, it is possible to complete the tubular case 50C, 50D, 50E or 50F by, for example, employing a configuration in which the rod-shaped core 20, which is attached with the coil 30 and the insulation member 40, is arranged on each of one and the other semi-tubular members constituting the tubular case 50C, 50D, 50E or 50F and thereafter, the one semi-tubular member and the other semi-tubular member are united. In addition, it is also allowed for the lid member 60 to be formed integrally with the tubular case 50C, 50D, 50E or 50F.

It should be noted for a general antenna device that there is included a bobbin which houses one slender rod-shaped core on the inner circumferential side thereof and, which has a coil wound on around outer circumferential side thereof and there is included a tubular case which houses that bobbin on the inner circumferential side thereof. On the contrary, for the antenna device 10 of the present exemplified embodiments which are exemplified in FIGS. 1 to 2 and in FIGS. 5 to 9, only the tubular cases 50 are used without using bobbins. More specifically, it is easy for the antenna device 10 of the present exemplified embodiment to realize a simplified structure in which the bobbin is omitted. It should be noted in case of omitting the bobbin that it becomes easy for the impact added to the tubular case 50 to transmit directly to the rod-shaped core 20 without dispersion and absorption to the bobbin. Therefore, in a general antenna device, for the structure in which the bobbin is omitted and only the case is used, it becomes easy to break the slender rod-shaped core when the impact is added.

However, according to the antenna device 10 of the present exemplified embodiment, instead of a single slender rod-shaped core, there are used a plurality of rod-shaped cores 20 obtained by dividing this slender rod-shaped core into two or more pieces. For this reason, even if an impact (lateral impact) from the direction approximately orthogonal to the axis direction of the rod-shaped core 20 is added, it is difficult for the core 20 to break. In addition, when a lateral impact is added, the place on which the impact is initially added easily is the flange portion 22, within the respective portions of the rod-shaped core 20, which is positioned at a place in most close to or in contact with the inner circumferential surface 50S of the tubular case 50. Then, for this flange portion 22, the thickness thereof in the direction orthogonal to the axis direction of the rod-shaped core 20 is the thickest and therefore, the breakage thereof becomes extremely difficult even if a lateral impact is added. More specifically, for the antenna device 10 of the present exemplified embodiment, there are used at least the first rod-shaped core 20A and the second rod-shaped core 20B each of which includes the flange portion 22 and therefore, it is difficult for the breakage of the rod-shaped core 20, which is caused by the lateral impact, to occur even if the bobbin is omitted. In addition to this aspect, since the bobbin can be omitted, it is also possible to simplify the structure of the antenna device 10.

However, for the antenna device 10 of the present exemplified embodiment, it is possible of course to use, if necessary, a configuration in which the bobbins, close to which the first rod-shaped core 20A and the second rod-shaped core 20B are housed on the inner circumferential side thereof and close to which at least the first coil 30A and the second coil 30B are arranged on the outer circumferential side thereof, are combined with the tubular case which houses those bobbins.

It should be noted that in FIGS. 1 to 2 and FIGS. 5 to 9, there were exemplified the antenna devices 10 each of which uses two rod-shaped cores 20, but it is also allowed for each of the antenna devices 10 of these exemplified embodiments to include three or more rod-shaped cores 20. In that case, it is enough if at least any two of the rod-shaped cores 20 have the flange portions 22 and if the flange portions 22 of the respective rod-shaped cores 20 are arranged to be faced to each other by maintaining the predetermined gap length G in the inside of the antenna device 10. In addition, it is also allowed, if necessary, to use the rod-shaped core 20 which is provided with the flange portions 22 at the both ends thereof.

Figure 10:
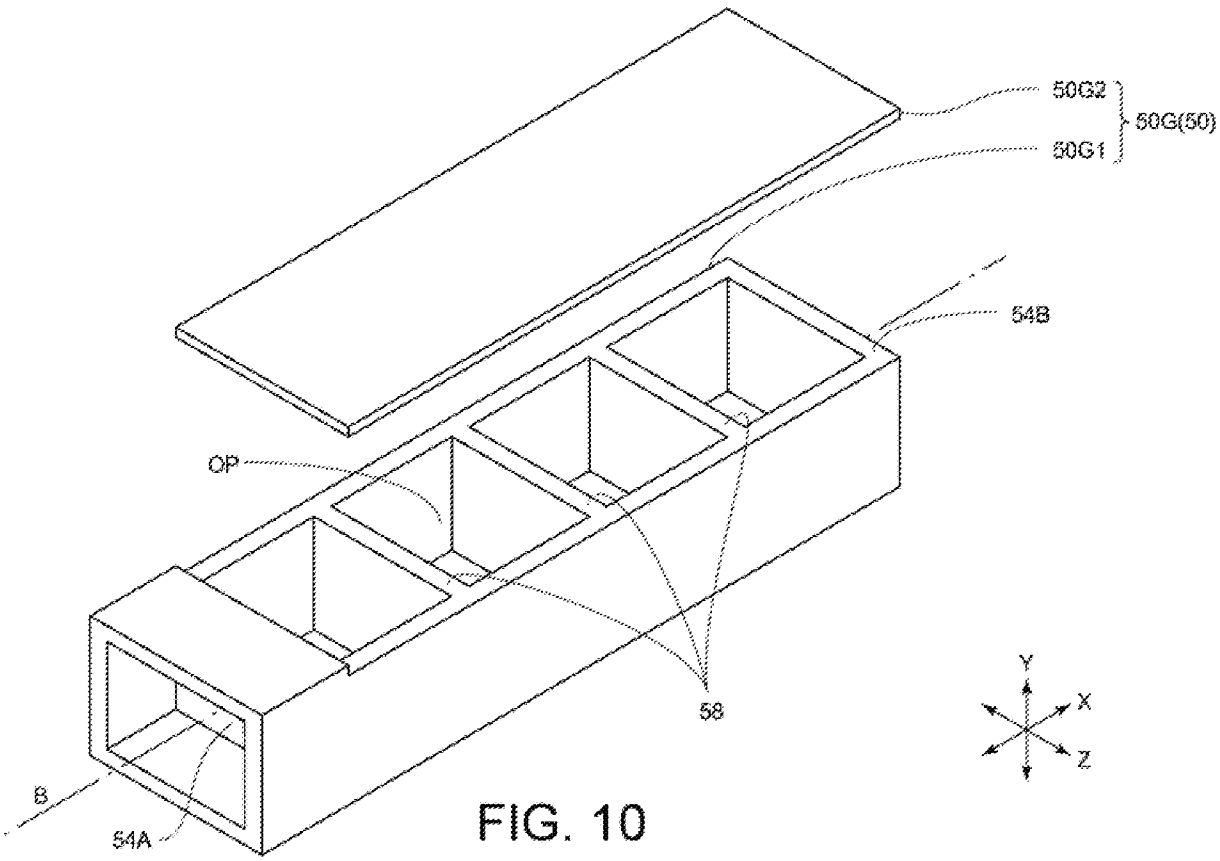
FIG. 10 is an outer-appearance perspective view showing another example of a tubular case which is used for the antenna device of the present exemplified embodiment.

In addition, in case of using tree or more rod-shaped cores 20, it is preferable for the tubular case 50 which is used for assembling the antenna device 10 to use a tubular case 50 including two or more partition plates 58. FIG. 10 is an outer-appearance perspective view showing another example of the tubular case 50 which is used for the antenna device 10 of the present exemplified embodiment. A tubular case 50G (50) shown in FIG. 10 includes a structure provided with three partition plates 58 which are formed integrally with the tubular case 50G on the inner circumferential side of the tubular case 50G so as to divide the space in the inside of the tubular case 50G having a square-tubular shape into approximately four equal spaces with respect to the center axis B of the tubular case 50G, which is in parallel with the X-axis direction. In addition, instead of the lid member 60 provided at the opening portion 52 of the tubular case 50A as shown in FIG. 1, there is formed, for the tubular case 50G shown in FIG. 10, a top wall portion 54B corresponding to the lid member 60 integrally with the tubular case 50G. The tubular case 50G is constituted by a tubular-case main-body portion 50G1 provided with opening portions OP on one surface side of the four outer circumferential surfaces of the tubular case 50G and a plate-shaped side-surface lid member 50G2 having shape and size corresponding to those of the opening portions OP. It should be noted that excepting the configurations explained above, the tubular case 50G shown in FIG. 10 includes a substantially similar structure as that of the tubular case shown in FIG. 1.

It is possible for the tubular case 50G including a plurality of partition plates 58 as exemplified in FIG. 10 to hold a plurality of rod-shaped cores 20 in the inside of the tubular case 50G easy and also stably. In addition, there are provided the opening portions OP on one surface within four outer circumferential surfaces of the tubular case main-body portion 50G1 and therefore, it is possible, on the occasion of assembling the antenna device 10, to insert and arrange the plurality of rod-shaped cores 20 simultaneously in the inside of the tubular case 50G from the same direction. Then, after the plurality of rod-shaped cores 20 are inserted and arranged simultaneously in the inside of the tubular case 50G, it is possible, by covering the opening portions OP by attaching the side-surface lid member 50G2 thereto, to complete the tubular case 50G. In addition to that aspect, it is possible to produce a mold, which is used when molding the tubular case 50G by using a resin material and the mold, easily and also inexpensively.

Figure 11:
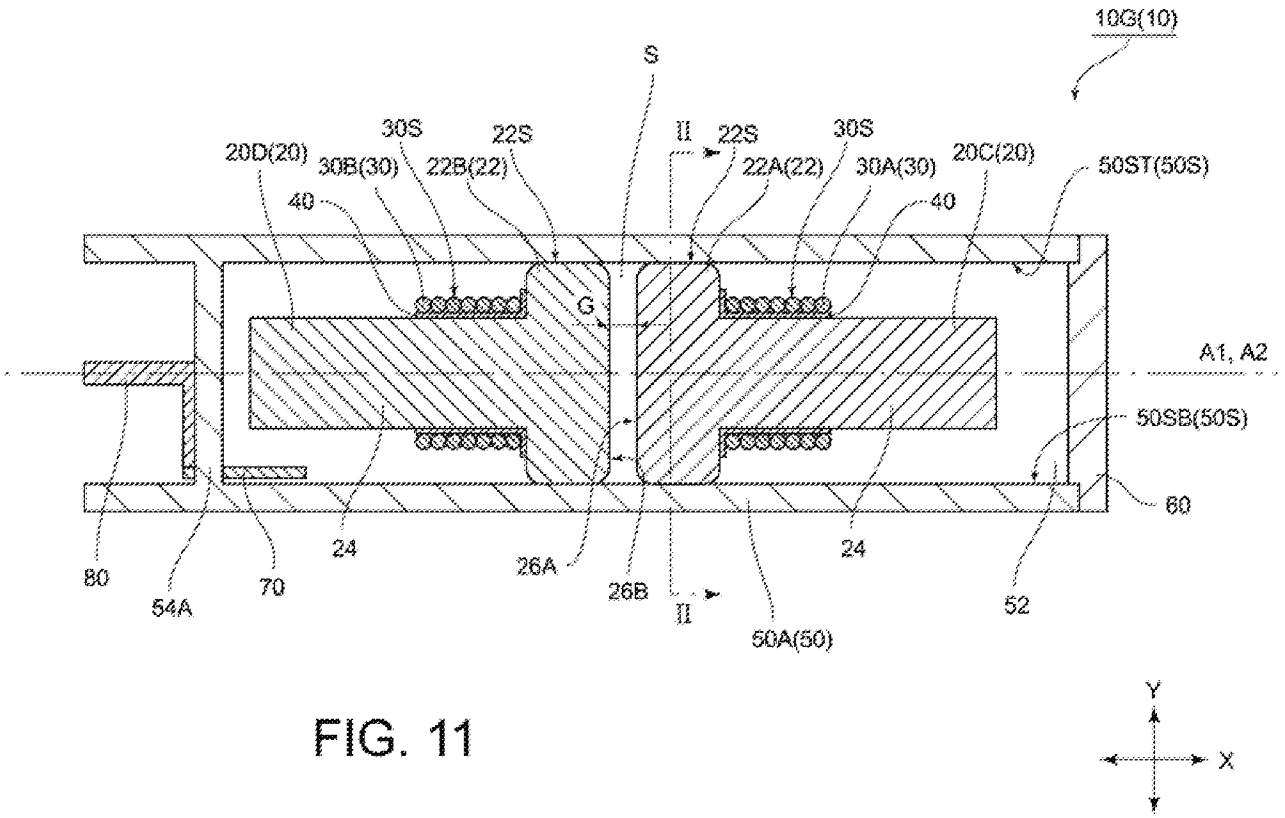
FIG. 11 is a partial cross-sectional view (XY cross-sectional view) showing another example of the antenna device of the present exemplified embodiment.

It should be noted that the edge portion of the flange portion 22 of the rod-shaped core 20 has an angulated shape as exemplified in FIG. 1 and the like, but it is allowed for the edge portion of the flange portion 22 to be formed in a round shape from the view point that the radio wave transmitted from the antenna device 10 can be sent as far as possible. For example, instead of the first rod-shaped core 20A and the second rod-shaped core 20B which are used for the antenna device 10A shown in FIG. 1 and in which the edge portions of the flange portions 22 are angulated, it is possible to use a first rod-shaped core 20C (20) and a second rod-shaped core 20D (20) such as an antenna device 10G (10) shown in FIG. 11 in which the edge portions of the flange portions 22 are formed in round shapes.

It is possible to use the antenna device 10 of the present exemplified embodiment as, for example, an LF band (30 kHz to 300 kHz) transmission antenna device for a short-range communication system and it is preferable to use it mainly for a keyless entry system for remote-controlling a lock of a vehicle door. On the other hand, the inductance-value L is defined by the following formula (1) and in the following formula (1), "L" is an inductance value, "A" is a constant value which depends on the number of coil-turns or the like, "N" is a demagnetizing factor and "μ" is a permeability.

$$L=A\times\mu/\{1+N\times(\mu-1)\} \quad \text{*Formula (1):}$$

Here, the permeability "μ" of the magnetic body material is a parameter which changes depending on the temperature. Then, the vehicles are utilized in various regions from cold regions to tropical regions and furthermore, there exist season fluctuations caused by such as summer and winter even in the same region and therefore, the use-temperature of the vehicle has a range of several tens degrees or more. Therefore, when using an antenna device provided with a rod-shaped core composed of a magnetic body material under an environment of temperature having a large change, it happens that the inductance-value L will fluctuate largely. On the other hand, the demagnetizing factor N is a factor which depends on the shape of the magnetic body and specifically, it is a factor which quantitatively indicates how much degree the magnetic flux in the opposite direction, which cancels the magnetic flux formed in the outside of the magnetic body, acts in the inside of the magnetic body. This demagnetizing factor N approaches 1 the more when the length of the magnetic body (distance between the magnetic poles) has the larger shape compared with the cross-sectional area of the magnetic-body cross-sectional surface in the plane-surface orthogonal to the length direction of the magnetic body (that is: when the shape of the rod-shaped core is the thicker and shorter), and the factor N approaches 0 the more when the length of the magnetic body has the opposite shape thereof (that is: when the shape of the rod-shaped core is the thinner and longer). Then, as recognized from the formula (1), the larger the demagnetizing factor N is (that is: the thicker and shorter the shape of the rod-shaped core is), the smaller the fluctuation-range of the inductance-value L with respect to the change of the permeability "μ" becomes.

Therefore, even in case of using the antenna device under an environment in which the temperature change is large, it is conceivable, if a thick and short shaped rod-shaped core is used, that the fluctuation of the inductance-value L can be suppressed drastically. However, there is a large limitation in the size for the antenna device using the keyless entry system and therefore, even though it is easy to shorten the shape of the rod-shaped core, it is often difficult to make the core thick. In addition to this matter, if only shortening the rod-shaped core while maintaining the thickness thereof, it happens that the inductance-value L will lower drastically. For this reason, in order to make the temperature dependency of the inductance-value L small while maintaining the inductance-value L, it is conceivable that it is effective to employ a configuration of dividing a single long and thin rod-shaped core into two or more pieces and replacing it by a plurality of thick and short rod-shaped cores.

Table-3 is a table which indicates measured results of the relative values of the inductance values L at the temperatures −40° C., −20° C., 0° C. and 20° C. when the inductance-value L at 20° C. is made to be a reference value (0%). It should be noted that Experimental-Example 1 in the Table-3 shows a measured result of the inductance-value L when as shown in FIG. 12A, a coil 210 is provided at the vicinity of the center portion in the direction of the center axis C1 of a single slender rod-shaped core 200, and Experimental-Example 2 shows a measured result of the inductance-value L when as shown in FIG. 12B, the coil 210 is provided at the vicinity of the center portion in the direction of the center axis D2 of a second rod-shaped core 202B selected within the first rod-shaped core 202A and the second rod-shaped core 202B, which are obtained by dividing the rod-shaped core 200, shown in FIG. 12A, into two pieces. It should be noted in FIG. 12B that the two rod-shaped cores 202A, 202B are arranged in series by providing a slight gap between the rod-shaped core 202A and the rod-shaped core 202B such that the respective center axes D1, D2 coincide with each other and, the gap length G will become more than 0 mm. As clear from the results shown in Table-3, it can be understood that by dividing a single long and thin rod-shaped core 200 into two pieces and replacing it by two thick and short rod-shaped cores 202A, 202B while maintaining the whole length as the rod-shaped core, the temperature dependency of the inductance-value L can be made small. More specifically, when compared with the antenna device using a single slender rod-shaped core, it is possible, for the antenna device 10 of the present exemplified embodiment including the plurality of rod-shaped cores 20 arranged in series, to suppress the inductance-value L from fluctuating largely also with respect to the change in temperature and further to suppress the resonant frequency from fluctuating largely also with respect thereto.

TABLE 3

| | Inductance-value L (%) | | | | Fluctuation-amount (%) of Inductance-value L at |
|---|---|---|---|---|---|
| | −40° C. | −20° C. | 0° C. | 20° C. | −40° C. to 20° C. |
| Experimental-Example 1 (FIG. 12A) | −0.91 | 0.00 | 0.13 | 0.00 | 1.03 |
| Experimental-Example 2 (FIG. 12B) | 0.06 | 0.39 | 0.39 | 0.00 | 0.39 |

Figure 13:
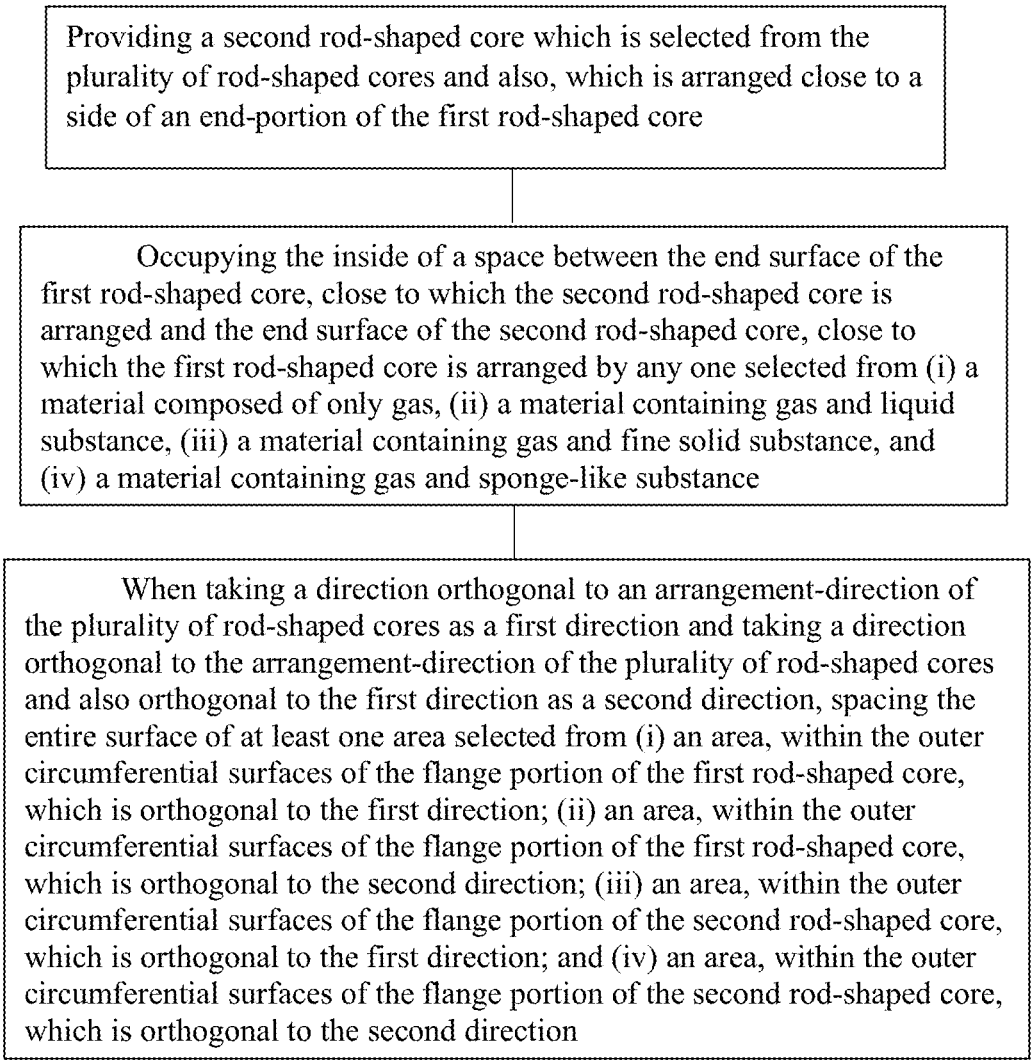
FIG. 13 is a diagram showing an exemplified embodiment of an antenna device.

FIG. 13 is a diagram shows an exemplified embodiment of an antenna device. For example, in the an antenna device, the inside of a space between the end surface of the first rod-shaped core, close to which the second rod-shaped core is arranged and the end surface of the second rod-shaped core, close to which the first rod-shaped core is arranged, may be occupied by any one selected from (i) a material composed of only gas, (ii) a material containing gas and liquid substance, (iii) a material containing gas and fine solid substance, and (iv) a material containing gas and sponge-like substance. In addition, when taking a direction orthogonal to an arrangement-direction of the plurality of rod-shaped cores as a first direction and taking a direction orthogonal to the arrangement-direction of the plurality of rod-shaped cores and also orthogonal to the first direction as a second direction, the entire surface of at least one area selected from (i) an area, within the outer circumferential surfaces of the flange portion of the first rod-shaped core, which is orthogonal to the first direction; (ii) an area, within the outer circumferential surfaces of the flange portion of the first rod-shaped core, which is orthogonal to the second direction; (iii) an area, within the outer circumferential surfaces of the flange portion of the second rod-shaped core, which is orthogonal to the first direction; and (iv) an area, within the outer circumferential surfaces of the flange portion of the second rod-shaped core, which is orthogonal to the second direction.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An antenna device comprising:

a plurality of rod-shaped cores arranged in series;

a first coil formed by winding a conductive wire around an outer circumferential side of a first rod-shaped core which is selected from the plurality of rod-shaped cores;

a second coil formed by winding a conductive wire around an outer circumferential side of a second rod-shaped core which is selected from the plurality of rod-shaped cores and which is arranged close to a side of an end-portion of the first rod-shaped core, wherein an end surface of the first rod-shaped core, close to which the second rod-shaped core is arranged, is spaced from an end surface of the second rod-shaped core, close to which the first rod-shaped core is arranged, a first flange portion provided at the end portion of the first rod-shaped core, close to which the second rod-shaped core is arranged, a second flange portion provided at an end portion of the second rod-shaped core, close to which the first rod-shaped core is arranged, wherein the antenna device further comprising:

a tubular housing member which houses at least the first rod-shaped core and the second rod-shaped core, wherein an inside of a space between the end surface of the first rod-shaped core, close to which the second rod-shaped core is arranged and the end surface of the second rod-shaped core, close to which the first rod-shaped core is arranged, is occupied by any one selected from the following materials of (i) to (iii):

(i) a material composed of only gas, (ii) a material containing gas and liquid substance, and (iii) a material containing gas and fine solid substance, wherein when taking a direction orthogonal to an arrangement-direction of the plurality of rod-shaped cores as a first direction and taking a direction orthogonal to the first direction as a second direction, an entire surface of at least one area selected from the following areas of (i) to (iv) is spaced from an inner circumferential surface of the tubular housing member:

(i) an area, within outer circumferential surfaces of the first flange portion of the first rod-shaped core, which is orthogonal to the first direction;

(ii) an area, within outer circumferential surfaces of the first flange portion of the first rod-shaped core, which is orthogonal to the second direction;

(iii) an area, within outer circumferential surfaces of the second flange portion of the second rod-shaped core, which is orthogonal to the first direction; and (iv) an area, within outer circumferential surfaces of the second flange portion of the second rod-shaped core, which is orthogonal to the second direction.

2. The antenna device according to claim 1, wherein and inner circumferential side of the tubular housing member is provided with the followings (A) to (C):

(A) either one member selected from the following (A1) and (A2): (A1) a partition plate which is in close contact with the end surface of the first rod-shaped core and which is in close contact with the end surface of the second rod-shaped core, and (A2) a protrusion which is in close contact with the end surface of the first rod-shaped core and which is in close contact with the end surface of the second rod-shaped core;

(B) a protrusion which is in close contact with an end surface positioned on an opposite side from the first flange portion, close to which the second rod-shaped c ore is provided; and (C) another protrusion which is in close contact with an end surface positioned on an opposite side from the second flange portion, close to which the first rod-shaped core is provided.

3. The antenna device according to claim 1, wherein the end surface of the first rod-shaped core, close to which the second rod-shaped core is arranged, and the end surface of the second rod-shaped core, close to which the first rod-shaped core is arranged, are bonded through an adhesive-agent layer.

4. The antenna device according to claim 1, wherein an inner circumferential side of the tubular housing member is provided with a first groove and a second groove so as to be neighboring each other with respect to a longitudinal direction of the tubular housing member;

wherein toward a direction in parallel with the arrangement-direction of the plurality of rod-shaped cores, a width of the first groove is identical with a width of the first flange portion, and a width of the second groove is identical with the width of the second flange portion; and wherein the circumferential portion of the first flange portion is fitted inside the first groove and a circumferential portion of the second flange portion is fitted inside the second groove.

* * * * *